US005933687A

United States Patent [19]

Okuno et al.

[11] Patent Number: 5,933,687

[45] Date of Patent: Aug. 3, 1999

[54] IMAGE FORMING APPARATUS HAVING A PLURALITY OF IMAGE HOLDING COMPONENTS

[75] Inventors: Jinju Okuno; Nozomu Kondo, both of Toyokawa, Japan

[73] Assignee: Minolta Co., Ltd., Osaka, Japan

[21] Appl. No.: 09/113,305

[22] Filed: Jul. 10, 1998

[30] Foreign Application Priority Data

Jul. 11, 1997 [JP] Japan ..... 9-187007
Jul. 30, 1997 [JP] Japan ..... 9-205006

[51] Int. Cl.[6] ..... G03G 15/00

[52] U.S. Cl. ..... 399/167

[58] Field of Search ..... 399/167, 223, 399/225, 226, 228

[56] References Cited

U.S. PATENT DOCUMENTS

| | | | |
|---|---|---|---|
| 4,806,968 | 2/1989 | Watanabe et al. | 399/92 |
| 4,928,144 | 5/1990 | Kasahara et al. | 399/228 |
| 5,060,020 | 10/1991 | Sakai | 399/223 |

FOREIGN PATENT DOCUMENTS 5-197244 6/1993 Japan .

*Primary Examiner*—S. Lee

*Attorney, Agent, or Firm*—McDermott, Will & Emery

[57] ABSTRACT

An image forming apparatus has a plurality of image holding components set along a transportation path of a recording sheet, each image holding component being operable at a full-color mode and a monochrome mode and an image holding component used for forming a black image being located nearest to the driving source. The image forming apparatus further has a worm shaft which is parallel to the transportation path of the recording sheet with one end being connected to a driving source, a worm wheel being attached to each image holding component and engaging with a corresponding worm, a clutch set to the worm shaft between the image holding component for black and an image holding component next to the image holding component for black, with the engagement and disengagement of the clutch being performed in synchronization with a switching operation to switch between the monochrome mode and the full-color mode, a rotational position detection unit for detecting a rotational position of the worm wheel set on the image holding component for black, and a storage unit for storing a rotational position of the worm wheels set on the image holding components when the clutch is disengaged. The clutch control unit engages the clutch when the rotational position detected by the rotational position detection unit is equal to the rotational position stored in the storage unit.

19 Claims, 18 Drawing Sheets

IMAGE FORMING APPARATUS HAVING A PLURALITY OF IMAGE HOLDING COMPONENTS

This application is based on applications No. 9-187007 and No. 9-205006 filed in Japan, the contents of which are hereby incorporated by reference.

BACKGROUND OF THE INVENTION (1) Field of the Invention

The present invention relates to a so-called "tandem-type" image forming apparatus where a plurality of image holding components, such as photosensitive drums, are set along the transportation path of a recording sheet.

(2) Related Art

Tandem-type image forming apparatuses have received much attention in recent years because of their ability to perform color printing at high speed.

A color copier, as one example of this type of image forming apparatus, has four photosensitive drums corresponding to four colors, i.e., cyan (C), magenta (M), yellow (Y), and black (K), set along the transportation path of a recording sheet. These photosensitive drums are made to rotate and are exposed to a scanning light beam. This forms an electrostatic latent image on the surfaces of the photosensitive drums. These electrostatic latent images are respectively developed into the corresponding color toner images. The toner images of cyan, magenta, yellow, and black respectively formed on the photosensitive drums are sequentially transferred onto a transported recording sheet. As a result, four color images are superimposed on the recording sheet to form a color image. Here, the mode where an image formation is performed with all of the photosensitive drums 41C to 41K being operative is referred to as the "full-color mode" hereinafter.

The photosensitive drums are rotated via the driving force of a motor. Suppose that a pulley which finally transmits the driving force to a photosensitive drum is mounted on the rotational shaft of each photosensitive drum. If the pulley is eccentric, the rotational speed of the photosensitive drums will fluctuate during each rotation of the pulley. In addition, if the speed fluctuation varies between photosensitive drums, color displacements occur in a color image formed on the recording sheet. To avoid this problem, there is a method whereby pulleys are respectively mounted on the rotational shafts of the photosensitive drums, with the eccentric directions being aligned. By means of this method, the fluctuation in the rotational speed of each photosensitive drum takes place at the same time, so that color displacements are prevented.

When performing operations aside from full-color image formation, such as when forming a black image using a tandem-type copier which is provided with a plurality of photosensitive drums, toner images are not formed on the photosensitive drums for cyan, magenta, and yellow, and a toner image is formed only on the photosensitive drum for black. Here, the mode where a black image formation is performed using only the photosensitive drum 41K used for forming a black image is referred to as the "monochrome mode" hereinafter.

For this reason, it is better for the photosensitive drums for C, M, and Y which are not used for forming the black image not to be rotated to prevent unnecessary wear and tear on these photosensitive drums and the cleaning blades that are in contact with them. However, if the photosensitive drum for K is only rotated while the photosensitive drums for C, M, and Y are not rotated, the eccentric direction of the pulley mounted on the rotational shaft of the photosensitive drum for K is misaligned with that of each pulley mounted on the rotational shafts of the photosensitive drums C, M, and Y. When a full-color image is formed in this state, color displacements occur in the transferred image.

Japanese Laid-Open Patent Application No. 5-197244 teaches a technique for realigning the eccentric directions of the pulleys that are misaligned during black image formation before full-color image formation is performed.

FIG. 1 shows a schematic construction of a driving mechanism for photosensitive drums provided in a copier disclosed in the cited Japanese Laid-Open Patent Application No. 5-197244.

As shown in FIG. 1, a gear 420 is integrally set on an output shaft 440 of a motor (not illustrated) at a lowest position. Relay shafts 320 and 330 are respectively set at the upper left and the upper right of the gear 420. A gear 400 is mounted on the relay shaft 320 via an electromagnetic clutch 390, while a gear 410 is integrally mounted on the relay shaft 330. The gears 400 and 410 respectively engage with the gear 420. Pulleys 350 and 360 are respectively mounted on the relay shafts 320 and 330 integrally.

Rotational shafts 300*a*, 300*b*, 300*c*, and 300*d* of the photosensitive drums for C to K (not illustrated) are set above the relay shafts 320 and 330. Pulleys 310*a*, 310*b*, 310*c*, and 310*d* are respectively mounted on the rotational shafts 300*a* to 300*d*. It is supposed that the eccentric directions of the pulleys 310*a* to 310*d* are aligned in FIG. 1.

Belts 370*a*, 370*b*, and 370*c* respectively run over the pulley 350 and the pulley 310*a*, the pulley 310*b*, and the pulley 310*c*. A belt 370*d* runs over the pulley 360 and the pulley 310*d*.

Interceptors 500 and 510 are respectively set on the pulley 310*a* and the pulley 310*d* at the positions shown in FIG. 1. Photo interrupters 520 and 530 are respectively set above the pulley 310*a* and the pulley 310*d* to respectively detect the interceptors 500 and 510.

When performing full-color image formation using a conventional copier which is provided with the stated driving mechanism, all of the photosensitive drums are rotated by turning on the electromagnetic clutch 390. Meanwhile, when performing the black image formation, the photosensitive drums for C, M, and Y are not rotated by turning off the electromagnetic clutch 390, so that only the photosensitive drum for K is rotated.

As a result, after black image formation is performed, the eccentric direction of the pulley 310*d* is misaligned with that of the pulleys 310*a* to 310*c*. In other words, the rotational angle of the pulley 310*d* measured between the photo interrupter 530 and the interceptor 510 is different from the rotational angle of the pulleys 310*a* to 310*c* measured between the photo interrupter 520 and the interceptor 500.

For this reason, before full-color image formation is performed, the motor (not illustrated) is activated after turning on the electromagnetic clutch 390. When the motor rotates at constant speed, a period of time $\Delta t$ (referred to as the "time $\Delta t$" hereinafter) is measured between when one photo interrupter detects the corresponding interceptor and when the other photo interrupter detects the other corresponding interrupter. The time $\Delta t$ is then compared with a predetermined allowable time. When the time $\Delta t$ is within the predetermined allowable time, full-color image formation is performed. On the other hand, when the time $\Delta t$ is not within the predetermined allowable time, the electromagnetic clutch 390 is turned off for a period of time corresponding to the time Δt. As a result, the eccentric directions of the pulleys 310*a* to 310*d* are aligned. In other words, the rotational angle of the pulley 310*d* that is measured from the photo interrupter 530 to the interceptor 510 can be made equal to the rotational angle of the other pulleys 310*a* to 310*c* measured form the photo interrupter 520 to the interceptor 500. Then, full-color image formation is performed. By doing so, color displacements in the full-color image formation can be prevented.

However, when a conventional copier, the processing for obtaining the time Δt needs to be performed before performing the full-color image formation to prevent the color displacements. As a result, the performance of the full-color image formation is delayed by the processing for obtaining the time Δt, meaning that it may take a long time to complete the full-color image formation.

In addition, although the three pulleys 531C to 531Y are respectively rotated by a driving force distributed from a single driving source, the conventional copier uses a driving force transmission mechanism that is realized by the belts. For this reason, there is also the risk that the eccentric directions of the pulleys 531C to 531Y may be misaligned due to skids between each belt and the corresponding pulley after an extended period of time of use.

SUMMARY OF THE INVENTION

The first object of the present invention is to provide an image forming apparatus which prevents color displacements and quickly commence an image formation.

The second object of the present invention is to provide an image forming apparatus which prevents unnecessary wear and tear on the components, such as the photosensitive drums, and also prevents color displacements even after an extended period of time of use.

The third object-of the present invention is to provide a mode switching method by which color displacements occurring in the full-color image formation can be prevented and by which the monochrome mode can be speedily switched to the full-color mode.

The first object of the present invention can be achieved by an image forming apparatus made up of: an image forming device which selectively operates in one of a full-color mode and a reduced-color mode, the full-color mode being where an image is formed using all of a plurality of photosensitive components that are set in line, and the reduced-color mode being where an image is formed using at least one but not all of the photosensitive components; a driving source for rotating the plurality of photosensitive components; a first driving force transmission unit for transmitting a driving force of the driving source to a first group including at least one photosensitive component; a driving force interruption unit for interrupting the driving force of the driving source for a second group including a plurality of photosensitive components aside from the photosensitive components included in the first group by being engaged and disengaged; a second driving force transmission unit for transmitting the driving force of the driving source to the second group via the driving force interruption unit when the driving force interruption unit is engaged; and a control unit for controlling an engaged state and a disengaged state of the driving force interruption unit in accordance with a current mode and for switching from the disengaged state to the engaged state when a phase of the photosensitive components in the first group is equal to a phase of the photosensitive components in the second group before the driving force interruption unit was switched to the disengaged state.

The first object of the present invention can also be achieved by an image forming apparatus made up of: a first group including at least one image holding component; a second group including a plurality of image holding components aside from the image holding components included in the first group; a driving device for driving the image holding components in the first group and the second group; a driving force transmission device for transmitting a driving force of the driving device to each image holding component; a transmission switching device for switching between a transmission state where the driving force is transmitted to the second group by the driving force transmission device and a non-transmission state where the driving force is not transmitted to the second group by the driving force transmission device; and a control device for controlling the transmission switching device to switch the state of the driving force transmission device from the non-transmission state to the transmission state when the phase of the image holding components in the first group is equal to the phase of the image holding components in the second group.

The second object of the present invention can be achieved an image forming apparatus made up of: a plurality of image holding components set along a transportation path of a recording sheet, each image holding component being operable at a monochrome mode and a full-color mode and an image holding component used for forming a black image being located nearest to the driving source; a worm shaft which is set parallel to the transportation path of the recording sheet with one end being connected to a driving source; a worm wheel engaging with the worm shaft; and a clutch which is set on the worm shaft and located between the image holding component used for forming a black image and an image holding component located next to the image holding component used for forming a black image, an engagement and a disengagement of the clutch being performed in synchronization with a switching operation to switch between the monochrome mode and the full-color mode.

The third object of the present invention can be achieved by a mode switching method for switching from a full-color mode to a reduced-color mode and for switching from the reduced-color mode to the full-color mode in an image forming apparatus which includes a first group including at least one image holding component, a second group including a plurality of image holding components aside from the image holding components included in the first group, a driving source for driving each image holding component, and a clutch for interrupting a driving force of the driving source transmitted to the second group, and which selectively operates in one of the full-color mode and the reduced-color mode, the full-color mode being where an image is formed using the first group and the second group, and the reduced-color mode being where an image is formed using only the first group, the mode switching method for switching from the full-color mode to the reduced-color mode including: a first step for detecting a rotational phase of one of image holding components; a second step for disengaging the clutch; and a third step for storing the rotational phase detected in the first step when the clutch is disengaged in the second step, and the mode switching method for switching from the reduced-color mode to the full-color mode including: a first step for detecting a rotational phase of the image holding components in the first group; a second step for judging whether the rotational phase of the image holding components in the first group detected in the first step is equal to the stored rotational phase; and a third step for engaging the clutch when the rotational phase of the image holding components in the first group detected in the first step is judged to be equal to the stored rotational phase.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENTS

The following is a description of embodiments of the image forming apparatus of the present invention. In the embodiments, a digital full-color copier is used as an example of such an image forming apparatus.

First Embodiment

Figure 2:
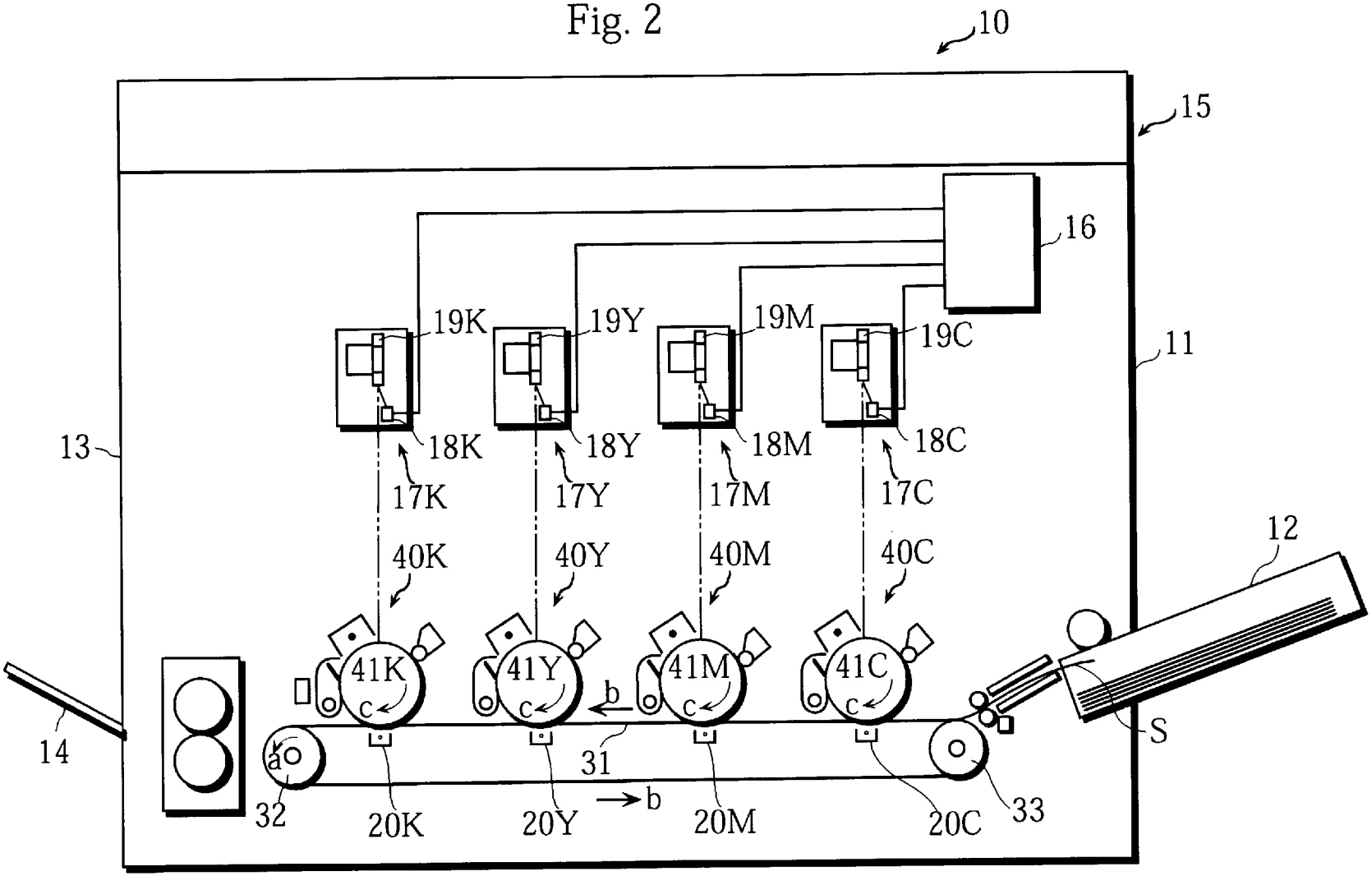
FIG. 2 shows an overall construction of a digital full-color copier of the first embodiment as one example of an image forming apparatus related to the present invention.

FIG. 2 shows a front view of the construction of the digital full-color copier (referred to as the "copier" hereinafter).

This copier is a so-called "tandem-type" copier. A paper feeding cassette 12 is set on a right-side wall 11 of an enclosure 10 and can be freely slid in and out of the copier. A paper discharge tray 14 is set on a left-side wall 13 and protrudes outward. A transport belt 31 is horizontally set in a lower space between the paper feeding cassette 12 and the paper discharge tray 14. A plurality (four in FIG. 2) of image forming units 40C, 40M, 40Y, and 40K are set above the transport belt 31 along its length. The transport belt 31 transports a recording sheet S, and the image forming units 40C to 40K successively transfer toner images for different colors onto the recording sheet S with the images being superimposed on the recording sheet S to form a full-color image.

An image reading unit 15 is set at the upper part of the enclosure 10. The image reading unit 15 optically reads an original document and transmits the read image data to an image processing unit 16 where necessary image processes are performed on the image data. The image processing unit 16 separates the image data into each color element, cyan (C), magenta (M), yellow (Y), and black (K). Then, laser diodes 18C to 18K of exposure units 17C to 17K set above the image forming units 40C to 40K are driven to perform light modulation in accordance with the corresponding color signals. The light-modulated beams respectively scan the corresponding photosensitive drums of the image forming units 40C to 40K in the main scanning direction using polygon mirrors 19C to 19K.

Figure 1:
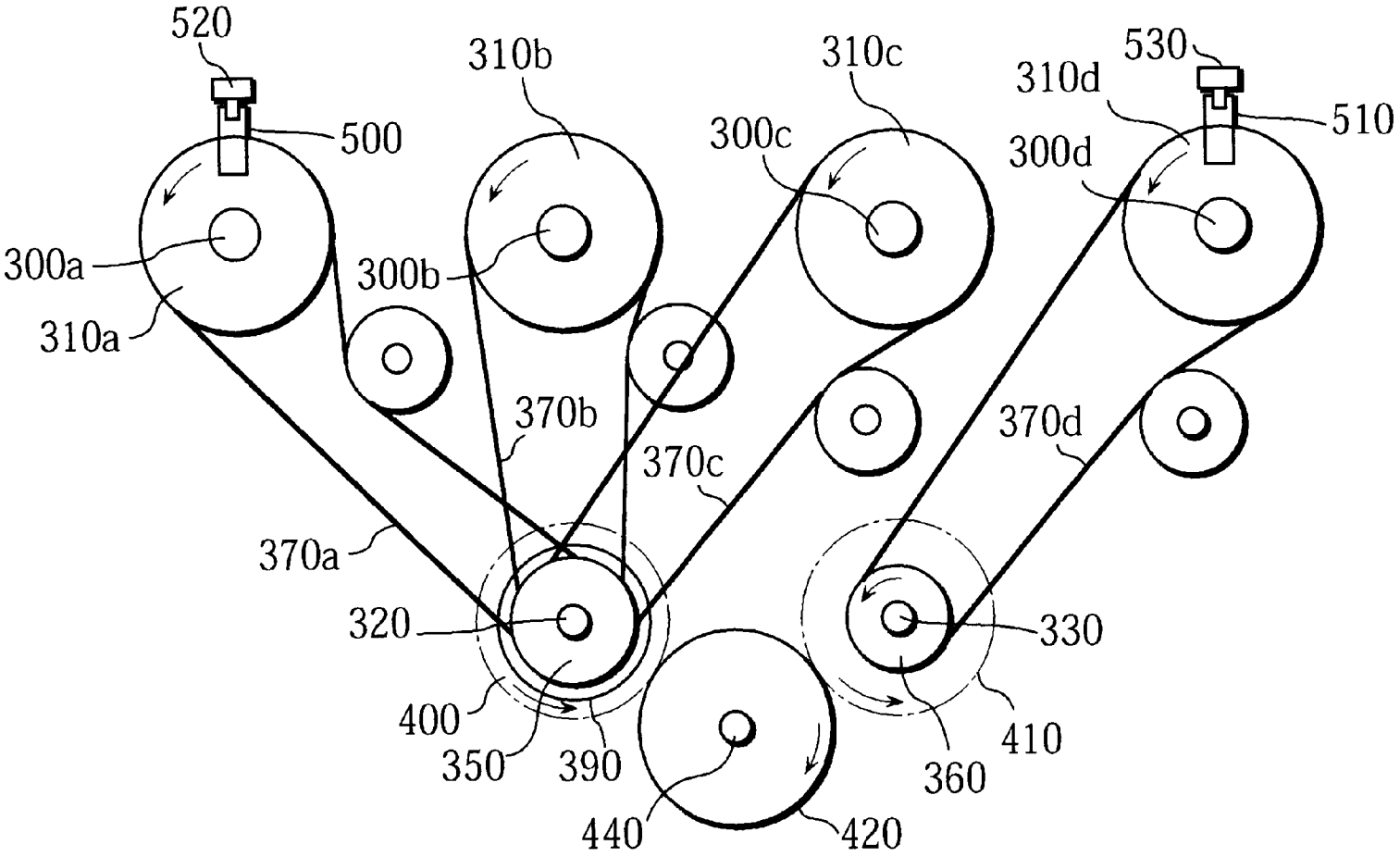
Fig. 1 PRIOR ART
FIG. 1 shows a schematic construction of a driving mechanism for photosensitive drums provided in a conventional copier.

The image forming units 40C to 40K respectively have unit constructions provided with photosensitive drums 41C to 41K as main components, sensitizing chargers, and developing units. By means of these unit constructions, images are formed using an electrostatic copying method. More specifically, the light-modulated beams expose the surfaces of the photosensitive drums 41C to 41K rotated in the direction of the arrow c shown in FIG. 1. Electrostatic latent images are formed on the surfaces of the photosensitive drums 41C to 41K and then visibly developed into toner images by the developing units. It should be noted here that toners C, M, Y, and K as developers corresponding to the light-modulated colors of the exposure units 17C to 17K are respectively supplied to the photosensitive drums 41C to 41K by the developing units.

Transfer chargers 20C to 20K are set underneath the photosensitive drums 41C to 41K of the image forming units 40C to 40K, with the transport belt 13 in between, so that each toner image formed on the photosensitive drums 41C to 41K is successively transferred onto the recording sheet S transported by the transport belt 31.

The transport belt 31 runs over a drive roller 32 and a slave roller 33. Together with the rotation of the drive roller 32 in the direction of the arrow a shown in FIG. 1, the transport belt 31 runs in the direction of the arrow b shown in FIG. 1.

The photosensitive drums 41C to 41K are set with a certain distance between them. Here, the certain distance is equivalent to an integral multiple of a distance moved by the transport belt 31 as a result of one rotation of the drive roller 32. In the present embodiment, the certain distance between the photosensitive drums 41C to 41K is set equivalent to the distance moved by the transport belt 31 as a result of one rotation of the drive roller 32.

Figure 3:
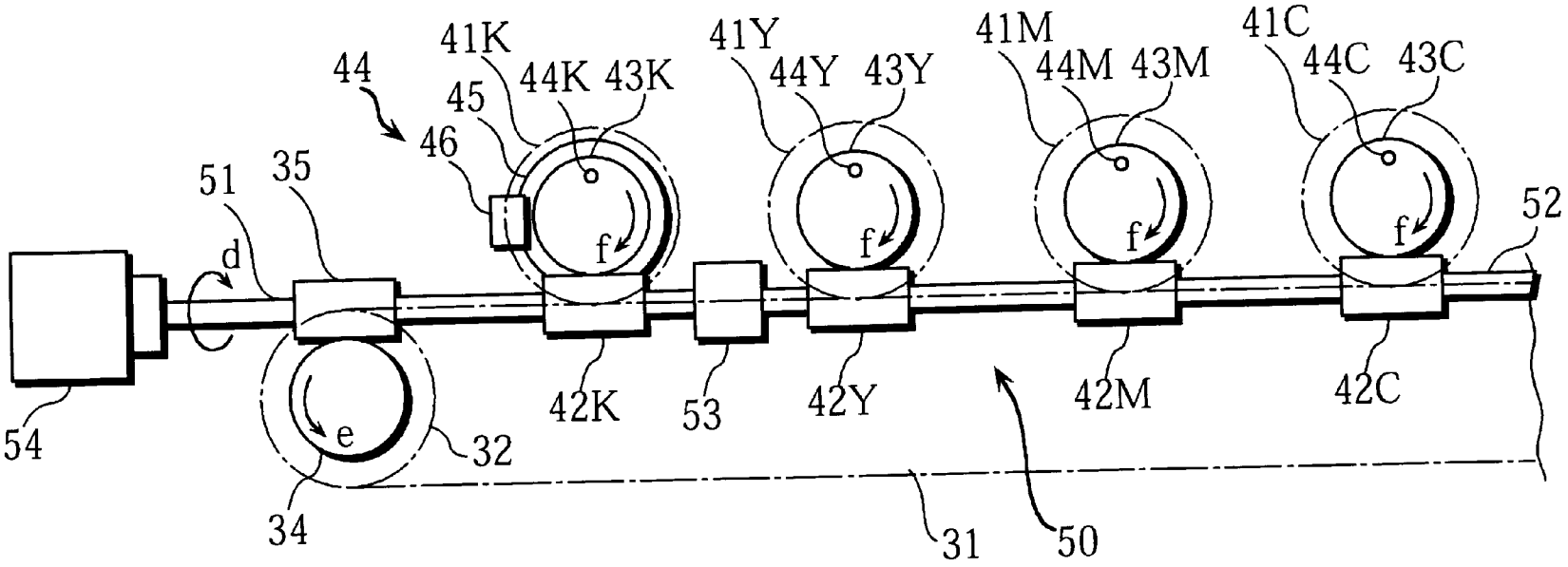
FIG. 3 shows a construction of a driving mechanism for photosensitive drums and a drive roller provided in the digital full-color copier.

The following is a description of a driving mechanism for the photosensitive drums 41C to 41K and the drive roller 32, with reference to FIG. 3.

FIG. 3 shows the schematic construction of the driving mechanism for the photosensitive drums 41C to 41K and the drive roller 32. As shown in FIG. 3, worm wheels 43C to 43K and 34 are respectively mounted on the front side ends of the rotational shafts (not illustrated) of the photosensitive drums 41C to 41K and the drive roller 32.

A worm shaft 50 is set parallel to the transport belt 31, i.e., in the transport direction of the recording sheet. The worm shaft 50 is provided with worms 42C to 42K and 35 which respectively engage with the worm wheels 43C to 43K and 34. The left end (as the copier is viewed in FIG. 3) of the worm shaft 50 is connected to an output shaft of a stepping motor 54 (referred to as the "motor 54" hereinafter). A well-known electromagnetic clutch (referred to as the "clutch 53" hereinafter) is set on the worm shaft 50. The clutch 53 is located between the photosensitive drum 41K used for forming a black image and the photosensitive drum 41Y located next to the photosensitive drum 41K. The worm shaft 50 is divided at the position of the clutch 53 into a first worm shaft 51 on the side of the photosensitive drum 41K and a second worm shaft 52 on the side of the photosensitive drums 41C to 41Y. With this structure, a driving force of the motor 54 transmitted to the second worm shaft 52 via the first worm shaft 51 is interrupted by the clutch 53. This is to say, the clutch 53 is activated when the driving force of the motor 54 is and is not transmitted to the second worm shaft 52.

It should be noted here that the "worm wheel" used in the present specification means a general gear wheel, such as a helical gear, which engages with a worm and transmits a driving force. Hereinafter, a pair of a worm and a worm wheel is referred to as a "worm gear".

With the construction of the worm gears, when the worm shaft 50 is rotated in the direction of the arrow d shown in FIG. 3, the worm wheels 43C to 43K of the worm gears are rotated in the direction of the arrow f and the worm wheel 34 is rotated in the direction of the arrow e. A reduction ratio of the worms and the worm wheels is predetermined in consideration of the diameter of the photosensitive drums 41C to 41K, the diameter of the drive roller 32, and the thickness of the transport belt 31, so that the circumferential speed of each photosensitive drum 41C to 41K is equivalent to the running speed of the transport belt 31. In the present embodiment, the radius of each photosensitive drum 41C to 41K is set equivalent to the sum of the radius of the drive roller 32 and the thickness of the transport belt 31 in its extended state. In addition, the same components are respectively used for all of the worms 42C to 42K and 35 and for all of the worm wheels 43C to 43K and 34. By this uniformity of components, costs can be reduced.

Each of the worm wheels 43C to 43K and 34 is made up of molded resin. Using molded resin, the cost can be further reduced due to mass production, and mechanical vibration incurred by the transmission of the driving force can also be reduced. In spite of these advantages, the molded resin is slightly deformed during manufacturing. If the photosensitive drums 41C to 41K are rotated via the driving force transmitted by the deformed worm wheels, the circumferential speed of the photosensitive drums 41C to 41K will fluctuate while the worm wheels make one rotation as one cycle. If the fluctuation phase is different for each of the photosensitive drums 41C to 41K, color displacements occur in the image transferred onto the recording sheet. However, deformation uniformly occurs to each molded component. As such, dents for marking (referred to as the "markings" hereinafter) are respectively put as markings 44C to 44K on outer regions of the worm wheels 43C to 43K. The worm gears are assembled, with all of the markings 44C to 44K being aligned at the same position (aligned at the upper position in FIG. 3). By doing so, the circumferential speed fluctuation for each of the photosensitive drums 41C to 41K is maintained uniform, so that color displacements can be prevented.

A rotary encoder 44 is set between the photosensitive drum 41K used for forming a black image and the worm wheel 43K. The rotary encoder 44 is composed of a slit circular plate 45 which is mounted on the rotational shaft of the photosensitive drum 41K and a photo interrupter 46 which is made up of a light-emitting element and a light-detecting element that face each other and are set on opposite sides of the slit circular plate 45. The photo interrupter 46 detects slits (not illustrated) in the slit circular plate 45 which is being rotated and outputs pulse signals (referred to as the "encoder pulses" hereinafter) to a CPU 62 shown in FIG. 4 (described later). It should be noted here that a number of slits in the slit circular plate 45 is N, with the N slits being uniformly spaced along the circumference of the slit circular plate 45.

Figure 4:
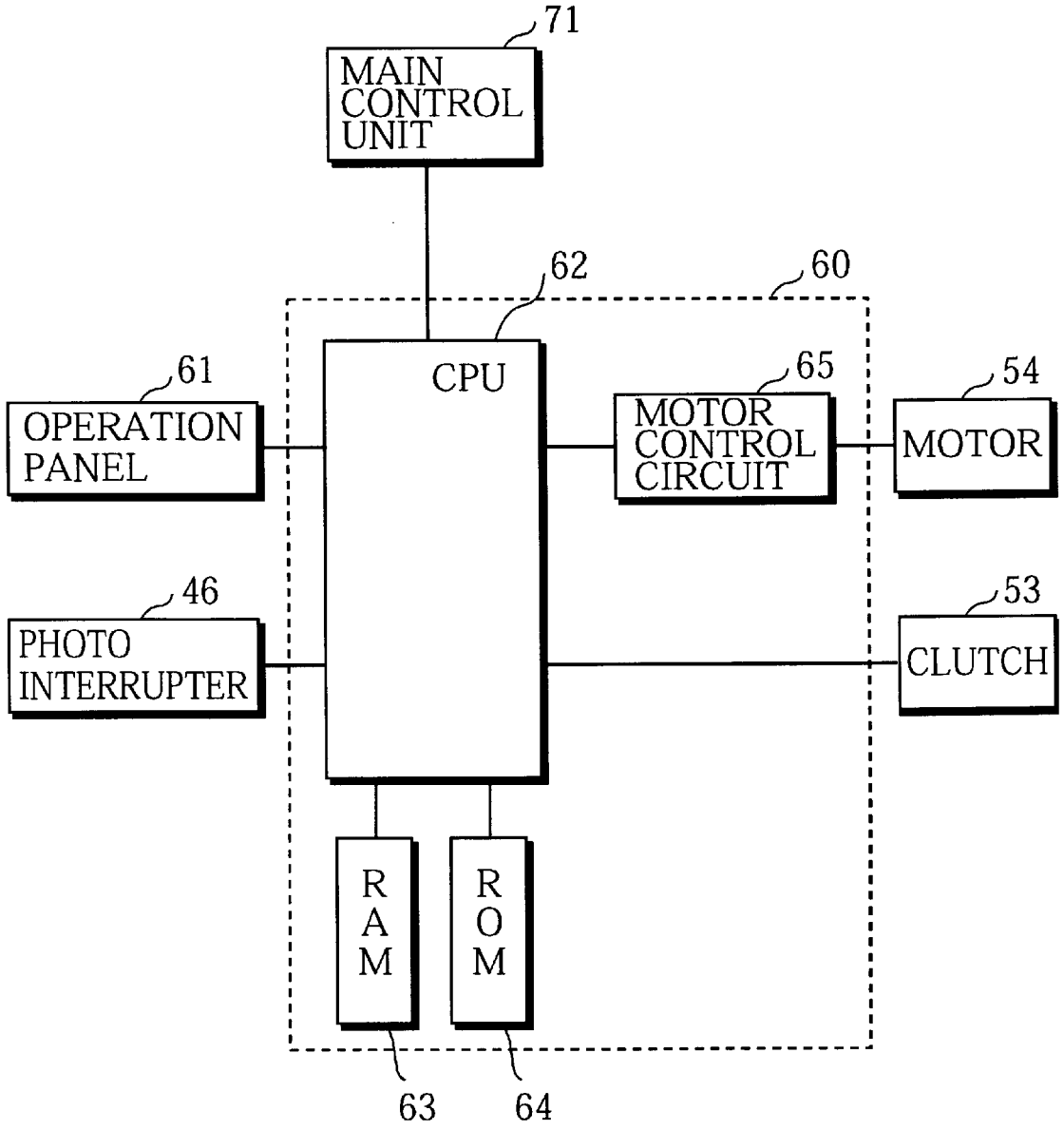
FIG. 4 is a block diagram showing a construction of a drive control unit which controls the photosensitive drums and the drive roller.

An operation panel 61 shown in FIG. 4 is provided at an optimum position on the top of the copier. The operation panel 61 is composed of a copy start key for indicating a start of copying, a numeric keypad for setting the number of copies, and various input keys including a mode switching key for selecting a monochrome mode or a full-color mode. The operation panel 61 also includes a display unit for displaying settings by the above keys.

The following is a description of a drive control unit 60 which controls the photosensitive drums 41C to 41K and the drive roller 32, with reference to the block diagram shown in FIG. 4.

As shown in FIG. 4, the drive control unit 60 is composed of a CPU 62 as the main component, a RAM 63, a ROM 64, and a motor control circuit 65 connected to a motor 54. The CPU 62 is connected to a main control unit 71 for controlling the entire copier, the operation panel 61, the photo interrupter 46, and the clutch 53. The CPU 62 performs various control operations according to programs stored in the ROM 64.

The RAM 63 serves as a work area when the CPU 62 executes the programs and includes a mode setting flag and a mode indicating flag. The mode setting flag indicates the current mode. When the mode setting flag is set at "0", this means that the monochrome mode is currently set. When the mode setting flag is set at "1", this means that the full-color mode is currently set. Meanwhile, the mode indicating flag indicates a mode indicated by the operation panel 61 or a mode indicated by the CPU 62 based on whether a read document is a black-and-white document or a color document. When the mode indicating flag is set at "0", this indicates the monochrome mode. When the mode indicating flag is set at "1", this indicates the full-color mode. The CPU 62 judges whether the current mode needs to be switched by comparing the mode setting flag with the mode indicating flag.

The motor control circuit 65, which is a well-known control circuit, drives the motor 54 in accordance with speed setting signals inputted from the CPU 62. The speed setting signals are transmitted in a pulse train (hereinafter, a pulse in the pulse train is referred to as the "driving pulse"). When a driving pulse is inputted to the motor control circuit 65, the motor 54 is rotated by one step angle. Accordingly, the CPU 62 can control the rotational angle of the motor 54 and also control the rotational speed of the motor 54 by changing the driving pulse rate.

The CPU 62 receives instructions from the main control unit 71 and the operation panel 61, as well as receiving the encoder pulses from the photo interrupter 46. By doing so, the CPU 62 controls the activation of the motor 54 and the engagement/disengagement of the clutch 53.

Figure 5:
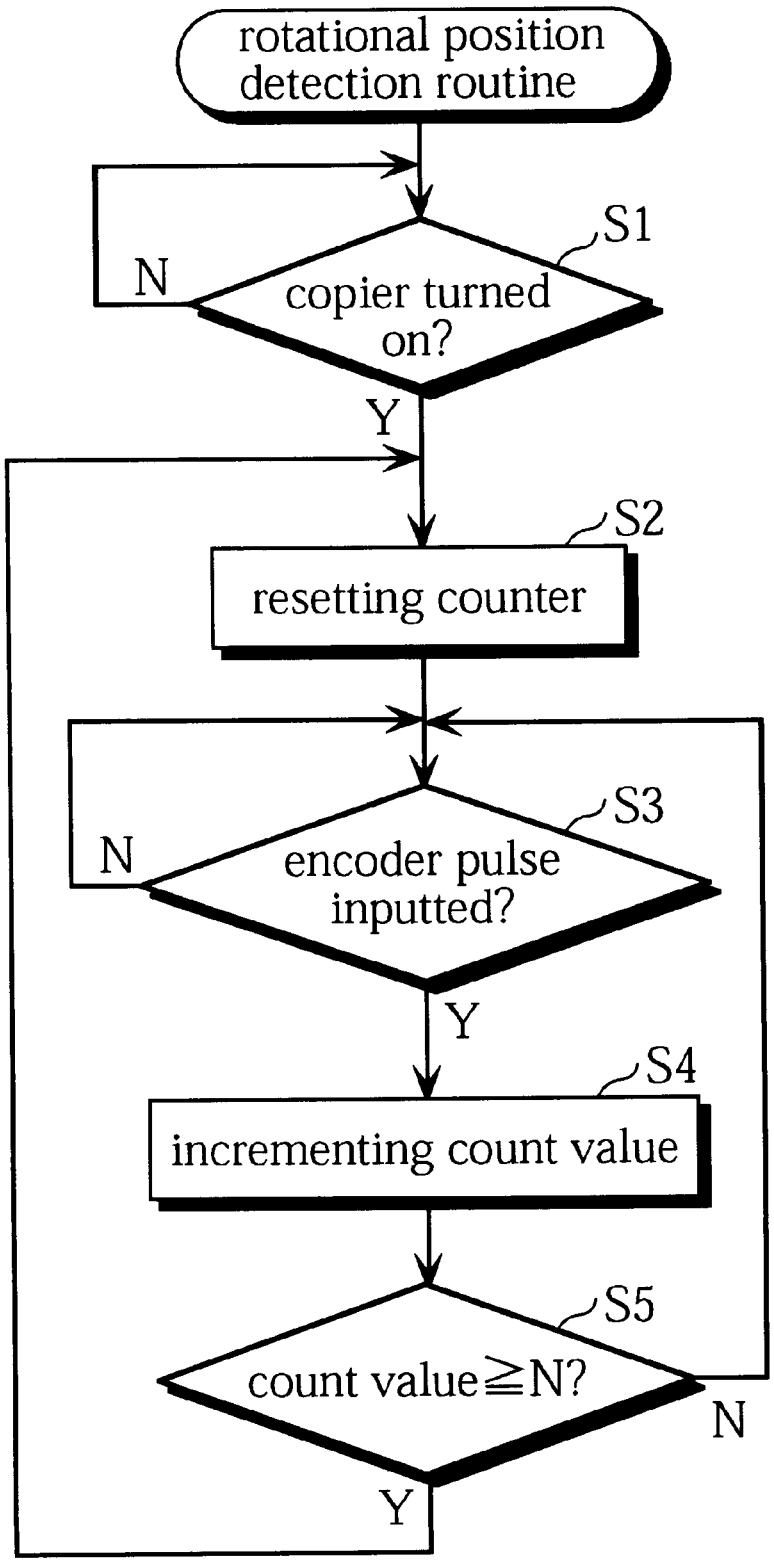
FIG. 5 is a flowchart showing a partial control operation by the drive control unit.
Figure 6:
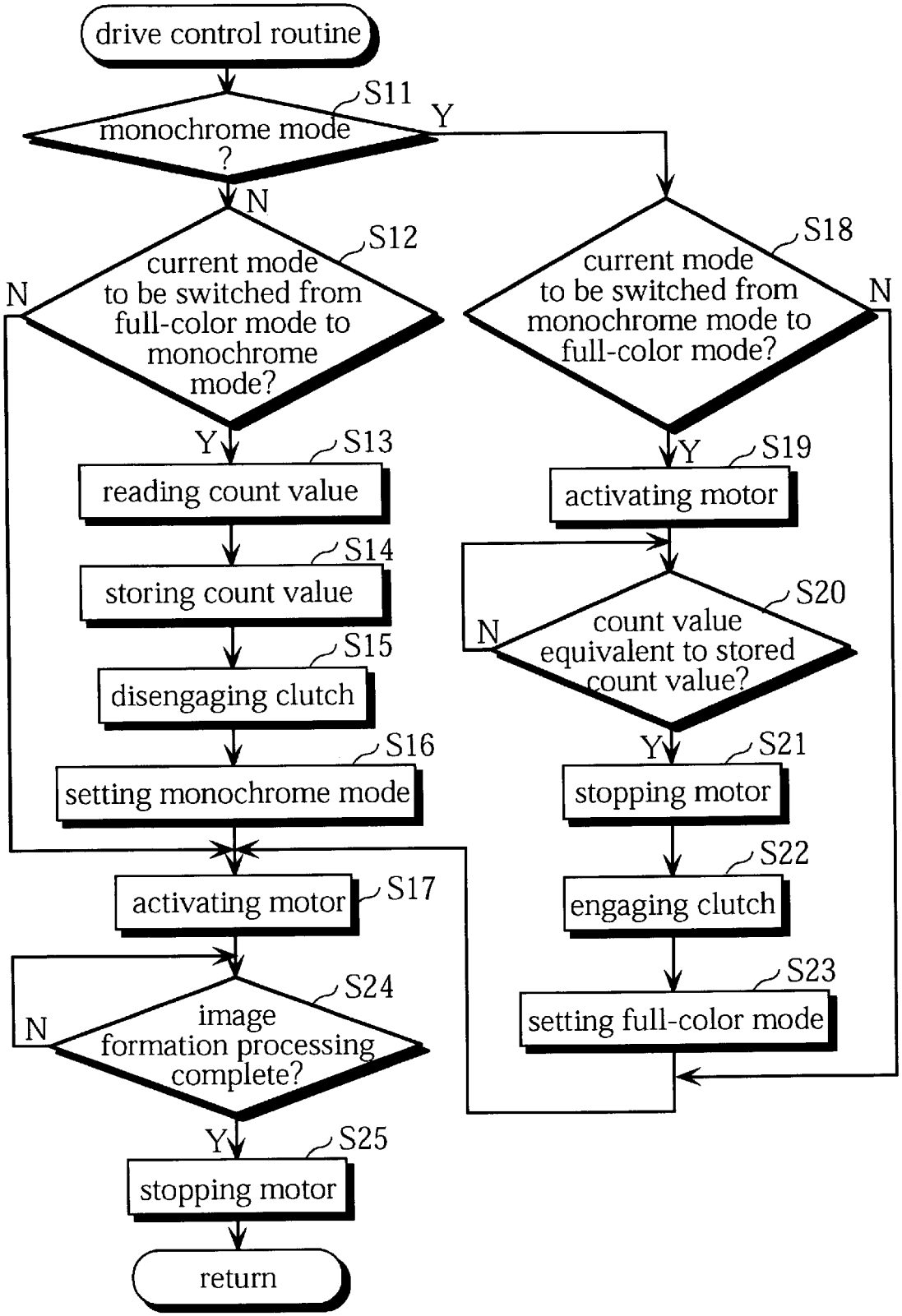
FIG. 6 is a flowchart showing a partial control operation by the drive control unit.

Next, the control operation performed by the drive control unit 60 is explained, with reference to the flowcharts shown in FIGS. 5 and 6.

The flowchart of FIG. 5 shows the rotational position detection routine for detecting the rotational position of the worm wheel 43K. This routine is activated when the copier is turned on and executed independently of other routines.

When the copier is turned on ("Yes" in step S1), the CPU 62 resets an internal counter (referred to as the "counter" hereinafter) to "0" (step S2). Every time an encoder pulse is received from the photo interrupter 46 ("Yes" in step S3), the CPU 62 increments a value of the counter (step S4). Hereinafter, the value of the counter is referred to as the "count value". When the count value reaches the number N which is the total number of slits in the slit circular plate 45 ("Yes" in step S5), the CPU 62 returns to step S2 to reset the count value to "0". After this, the CPU 62 repeats the processing from step S3 to step S5. In this way, the rotational position of the worm wheel 43K, i.e., how far the worm wheel 43K has been rotated from a position detected as a standard position when the copier was turned on, is measured by referring to the current count value. Accordingly, the CPU 62 can detect the rotational position of the worm wheel 43K.

The flowchart of FIG. 6 shows the drive control routine performed by the CPU 62 for controlling the photosensitive drums 41C to 41K and the drive roller 32. This drive control routine is activated by an instruction from the main control unit 71.

The CPU 62 judges from the mode setting flag whether the monochrome mode is currently set (step S11). If the monochrome mode is not currently set, that is, if the mode setting flag is set at "1", the CPU 62 proceeds to step S12 to judge from the mode indicating flag whether the current mode needs to be switched from the full-color mode to the monochrome mode. If judging so, that is, if the mode indicating flag is set to "0", the CPU 62 reads the count value (step S13) and stored the read count value in the RAM 63 (step S14). Simultaneously, the CPU 62 controls the clutch 53 to be disengaged (step S15) and sets the mode to the monochrome mode, as well as setting the mode setting flag to "0" (step S16). Then, the CPU 62 activates the motor 54 (step S17). If judging that the current mode does not need to be switched from the full-color mode to the monochrome mode in step S12, that is, if the mode indicating flag is set at "1", the CPU 62 skips steps S13 to S16 and activates the motor 54 (step S17).

Meanwhile, on judging that the monochrome mode is set in step S11, that is, if the mode setting flag is set at "0", the CPU 62 proceeds to step S18 to judge from the mode indicating flag whether the current mode needs to be switched from the monochrome mode to the full-color mode. If so, that is, if the mode indicating flag is set at "1", the CPU 62 activates the motor 54 (step S19). When the count value reaches the count value stored in the RAM 63 ("Yes" in step S20), the CPU 62 stops the motor 54 (step S21) as well as engaging the clutch 53 (step S22). Simultaneously, the CPU 62 sets the mode to the full-color mode (step S23), by setting the mode setting flag to "1", and activates the motor 54 (step S17). On judging that the current mode does not need to be switched to the full-color mode in step S18, that is, if judging that the mode indicating flag is set at "0", the CPU 62 skips steps S19 to S23 and activates the motor 54 (step S17).

After activating the motor 54 in step S17, the CPU 62 waits for a signal indicating the completion of the image formation processing inputted from the main control unit 71 ("Yes" in step S24). On receiving the signal from the main control unit 71, the CPU 62 controls the motor 54 to stop (step S25) and then returns. As one example, the signal indicating the completion of the image formation processing is inputted when all of toner images have been transferred onto the recording sheet and the trailing edge of the recording sheet has been detected by a detecting sensor provided above the drive roller 32, so that the recording sheet does not need to be further transported by the transport belt 31. As described above, when the image formation is performed in the monochrome mode using the image forming apparatus of the present invention (i.e., when the CPU 62 judges "Yes" in step S11, "No" in step S18 or step S1, and "Yes" in step S12), the clutch 53 is disengaged. As a result, the transmission of the driving force of the motor 54 is cut off via the clutch 53, so that the photosensitive drums 41C to 41Y which are not used for forming the image in the monochrome mode are not rotated. This can prevents unnecessary wear and tear on the photosensitive drums 41C to 41Y incurred by unnecessary rotation.

In addition, the worm wheels 43C to 43K respectively mounted on the rotational shafts of the photosensitive drums 41C to 41K are set in the manner that deformations of the worm wheels 43C to 43K are aligned in the same direction. The clutch 53 is engaged when the rotational position of the worm wheel 43K returns to its position at the previous disengagement of the clutch 53. As such, even after the clutch 53 is disengaged for mode switching to perform the image formation in the monochrome mode, the deformations of the worm wheels 43C to 43K are aligned in the same direction when the image formation is next performed in the full-color mode. This prevents color displacements incurred by the deformations of the worm wheels 43C to 43K.

Each certain distance between the transfer positions of the photosensitive drums 41C to 41K is set at the distance moved by the transport belt 31 as a result of one rotation of the drive roller 32. As a result, one cycle of the fluctuation in the running speed of the transport belt 31 incurred by the eccentricity of the drive roller 32 corresponds to the period of time taken for the recording sheet to be transported from one transfer position to another, which prevents color displacements. This is also the case where the certain distance is set at an integral multiple of a distance moved by the transport belt 31 as a result of one rotation of the drive roller 32.

Since the driving force is transmitted via the worm gears, the worm wheels rotate together with the worms. However, the worms do not rotate together with the worm wheels due to a so-called "self-locking" mechanism of the worm gears. By means of this self-locking mechanism, vibration of one photosensitive drum is not propagated to the other photosensitive drums via a driving force transmission mechanism (including the worm gears and their rotational shafts). As a result, a problem, such as where deterioration in image quality in the transferred image due to the vibration of one photosensitive drum being exacerbated by vibrations of the other photosensitive drums, can be avoided.

In the present embodiment, the rotational position of the worm wheel 43K is detected using the rotary encoder 44 by counting the encoder pulses outputted from the photo interrupter 46. However, a detection method for detecting the rotational position of the worm wheel 43K is not limited to this, and the following method can be used.

A reduction ratio between the worm 42K and the worm wheel 43K may be set so that the worm wheel 43K makes one rotation when the motor 54 rotates a convenient number of steps (for example, M steps). Instead of counting the encoder pulses, the counter provided in the CPU 62 may count the driving pulses inputted from the CPU 62 to the motor control circuit 65, and the CPU 62 may reset the count value when the count value reaches M. Accordingly, a rotary encoder is not needed and cost can be reduced.

Second Embodiment

The construction of the copier of the second embodiment is basically the same as that of the first embodiment, aside from the structure of slits in the slit circular plate and the partial control operation performed by the drive control unit. Therefore, the explanation of the common components is not given and only different components are described in the second embodiment.

Figure 7:
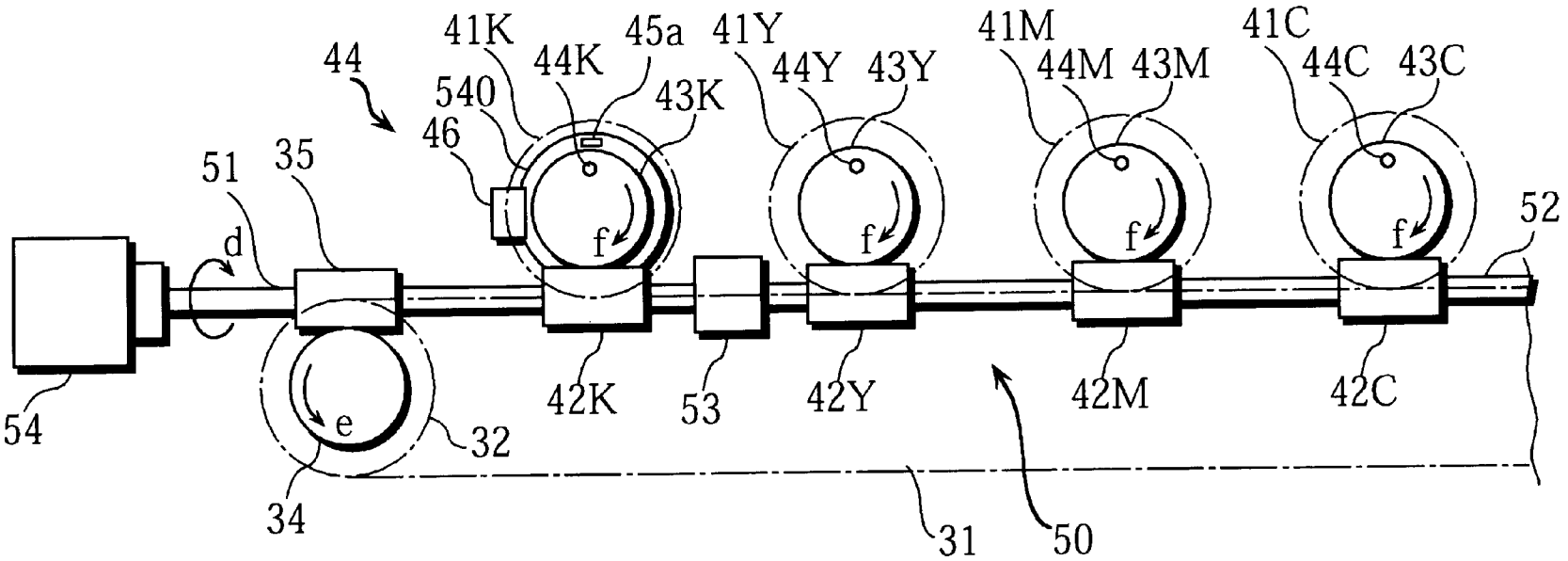
FIG. 7 shows a construction of a driving mechanism for the photosensitive drums and the drive roller provided in the digital full-color copier of the second embodiment.

One of a plurality of slits in a slit circular plate 540 of the second embodiment is circumferentially longer than the other slits. This slit is referred to as the "standard slit 45*a*" hereinafter. As shown in FIG. 7, the standard slit 45*a* is located on the diameter where the marking 44K is located. The other slits on the slit circular plate 540 are not illustrated.

The detection time of the standard slit 45*a* by the photo interrupter 46 is longer than the detection time of the other slits. This quality is used by the CPU 62 (shown in FIG. 4) to identify the standard slit 45*a*.

The CPU 62 receives instructions from the main control unit 71 and the operation panel 61 as well as receiving the encoder pulses from the photo interrupter 46, and obtains the rotational phase angle (referred to as the "phase angle" hereinafter) of the photosensitive drum 41K. More specifically, the phase angel of the photosensitive drum 41K is measured between the position where the photo interrupter 46 is located and the standard slit 45*a*. The position of the photo interrupter 46 is referred to as the "standard position". Thus, the CPU 62 controls the activation of the motor 54 and the engagement/disengagement of the clutch 53.

Figure 10:
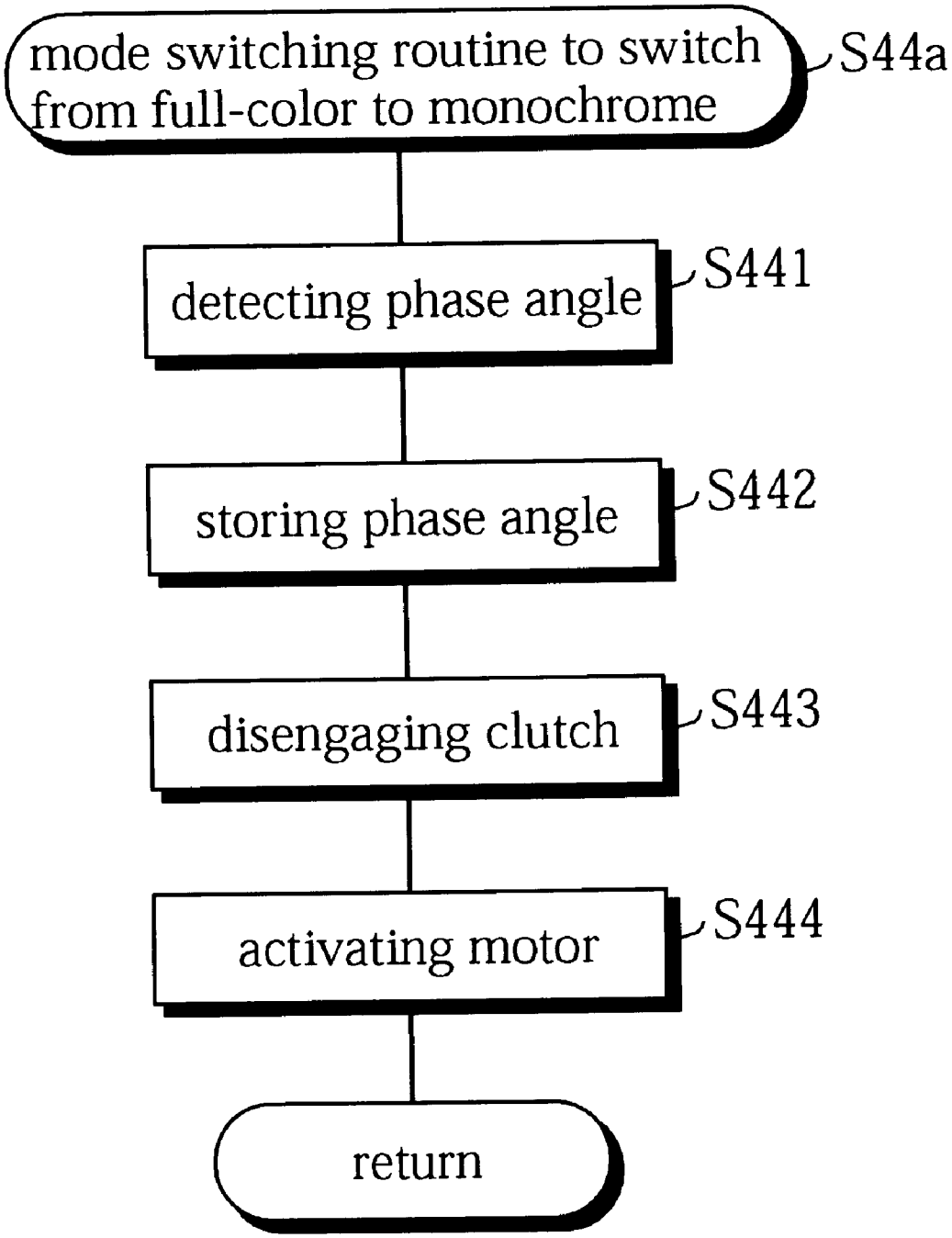
FIG. 10 shows a subroutine of the mode switch processing for switching from a full-color mode to a monochrome mode shown in FIG. 9.
Figure 11:
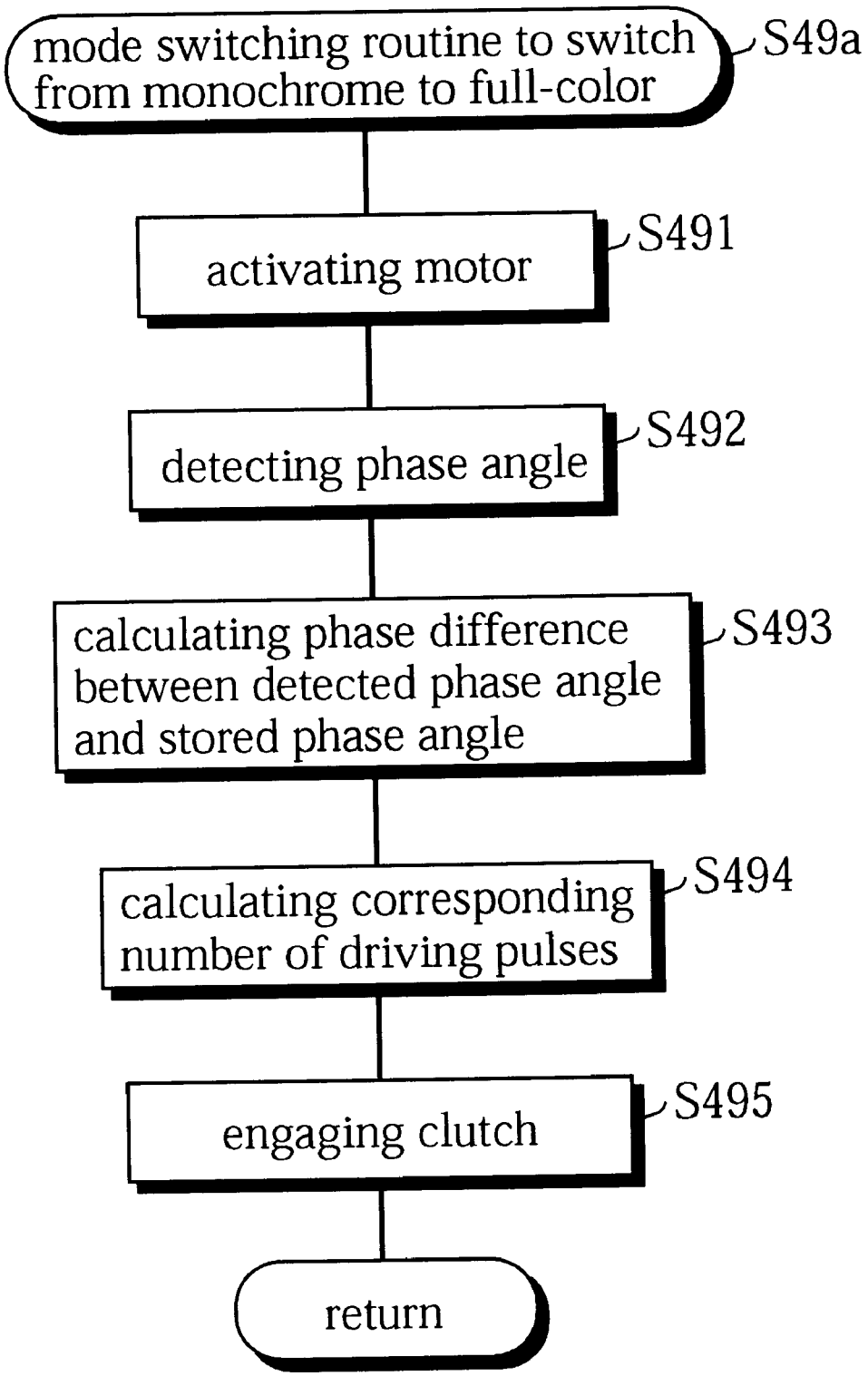
FIG. 11 shows a subroutine of the mode switch processing for switching from the full-color mode to the monochrome mode performed in step S49*a* of FIG. 9.
Figure 12:
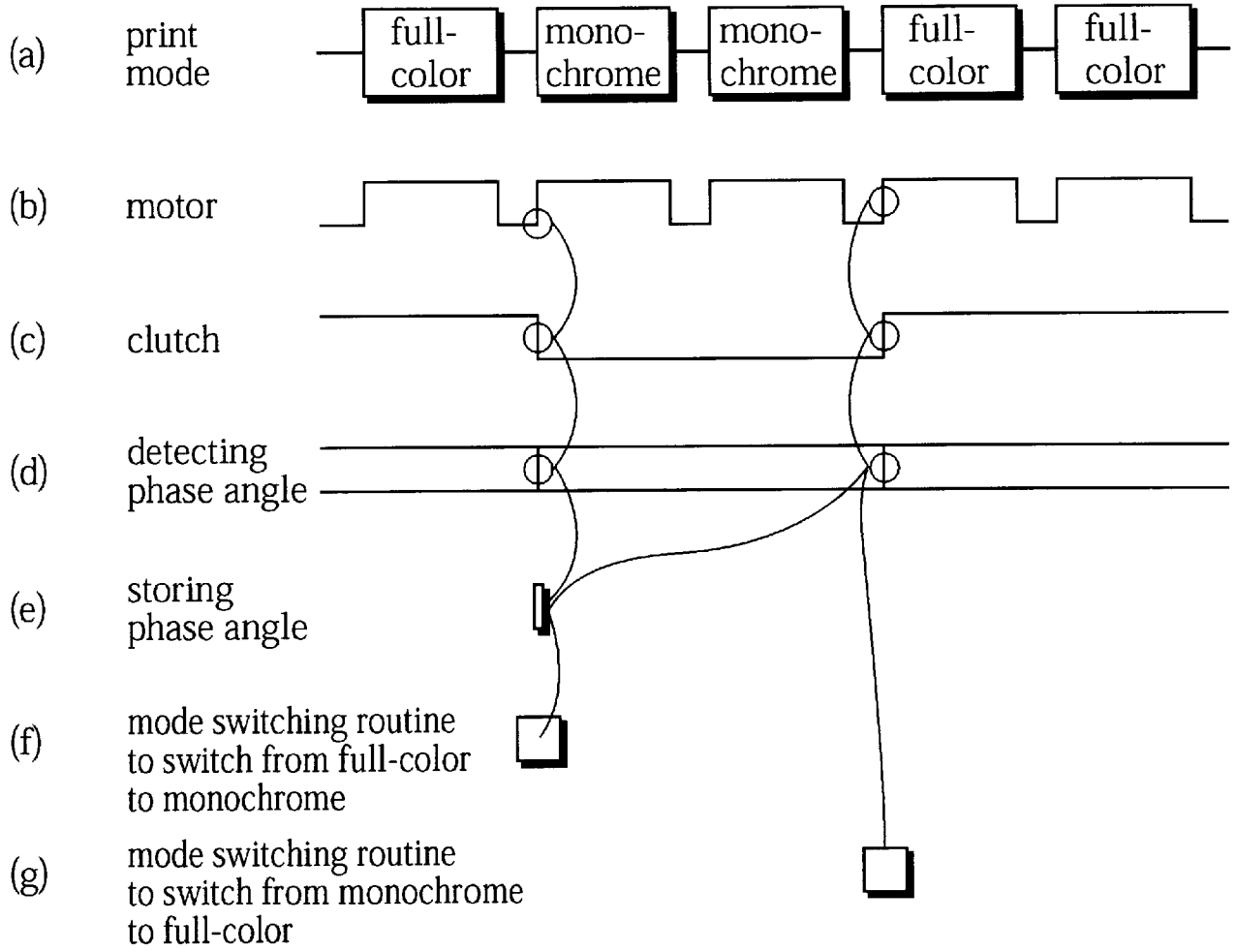
FIG. 12 is a timing chart of the control operation performed by the drive control unit.

Next, the control operation performed by the drive control unit 60 is described, with reference to the flowcharts of FIGS. 8 to 11 and the timing chart of FIG. 12.

Figure 8:
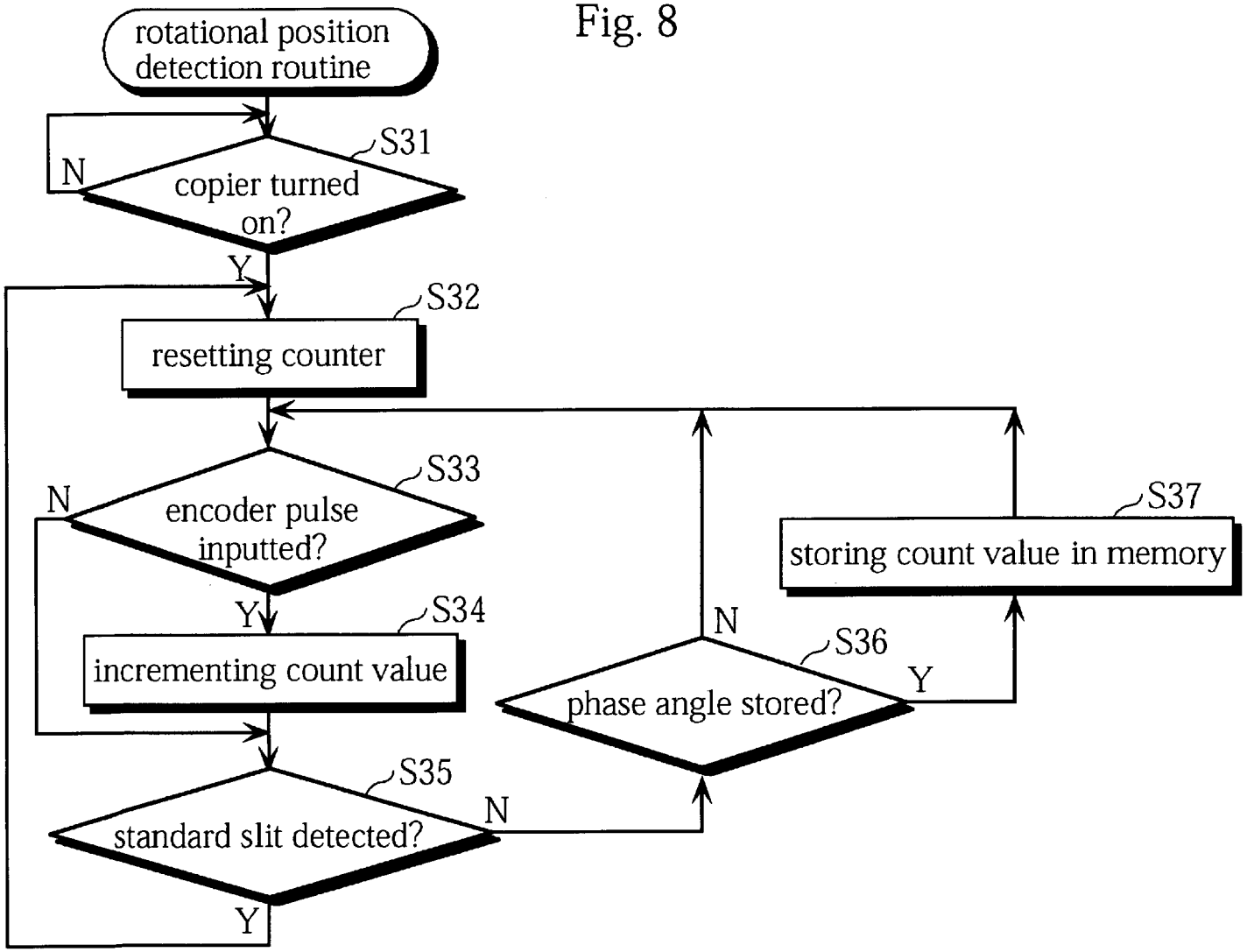
FIG. 8 is a flowchart showing a partial control operation by the drive control unit of the second embodiment.

FIG. 8 shows a rotational position detection routine for detecting the rotational position of the worm wheel 43K. This rotational position detection routine is activated when the copier is turned on and executed independently of other routines.

When the copier is turned on ("Yes" in step S31), the CPU 62 resets an internal counter provided in the work area of the RAM 63 (referred to as the "counter" hereinafter) to "0" (step S32). Every time an encoder pulse is inputted from the photo interrupter 46 while the slit circular plate 45 is being rotated ("Yes" in step S33), the CPU 62 increments a value of the counter (step S34). Hereinafter, the value of the counter is referred to as the "count value". When the photo interrupter 46 detects the standard slit 45*a* of the slit circular plate 45 ("Yes" in step 35), the CPU 62 return to step S32 to reset the count value to "0" and repeats the processing from steps S33 to S35. If the phase angle of the worm wheel 43K measured from the standard position needs to be stored ("Yes" in step S36), the CPU 62 stores the count value of the counter in a memory which is another work area in the RAM 63 (step S37) and then returns to step S33. If not necessary to store the phase angle, the CPU 62 skips step S37 and returns to step S33.

In this way, the CPU 62 can detect the rotational position of the worm wheel 43K, that is, the phase angle of the photosensitive drum 41K, by referring to the count value of the counter. Before the photo interrupter 46 detects the standard slit 45*a*, the phase angle is measured between the position of the standard slit 45*a* as a temporary standard position when the copier was turned on and the current position of the standard slit 45*a* by referring to the count value. Meanwhile, after the photo interrupter 46 detects the standard slit 45*a*, the phase angle is measured between the standard position and the current position of the standard slit 45*a* by referring to the count value.

Figure 9:
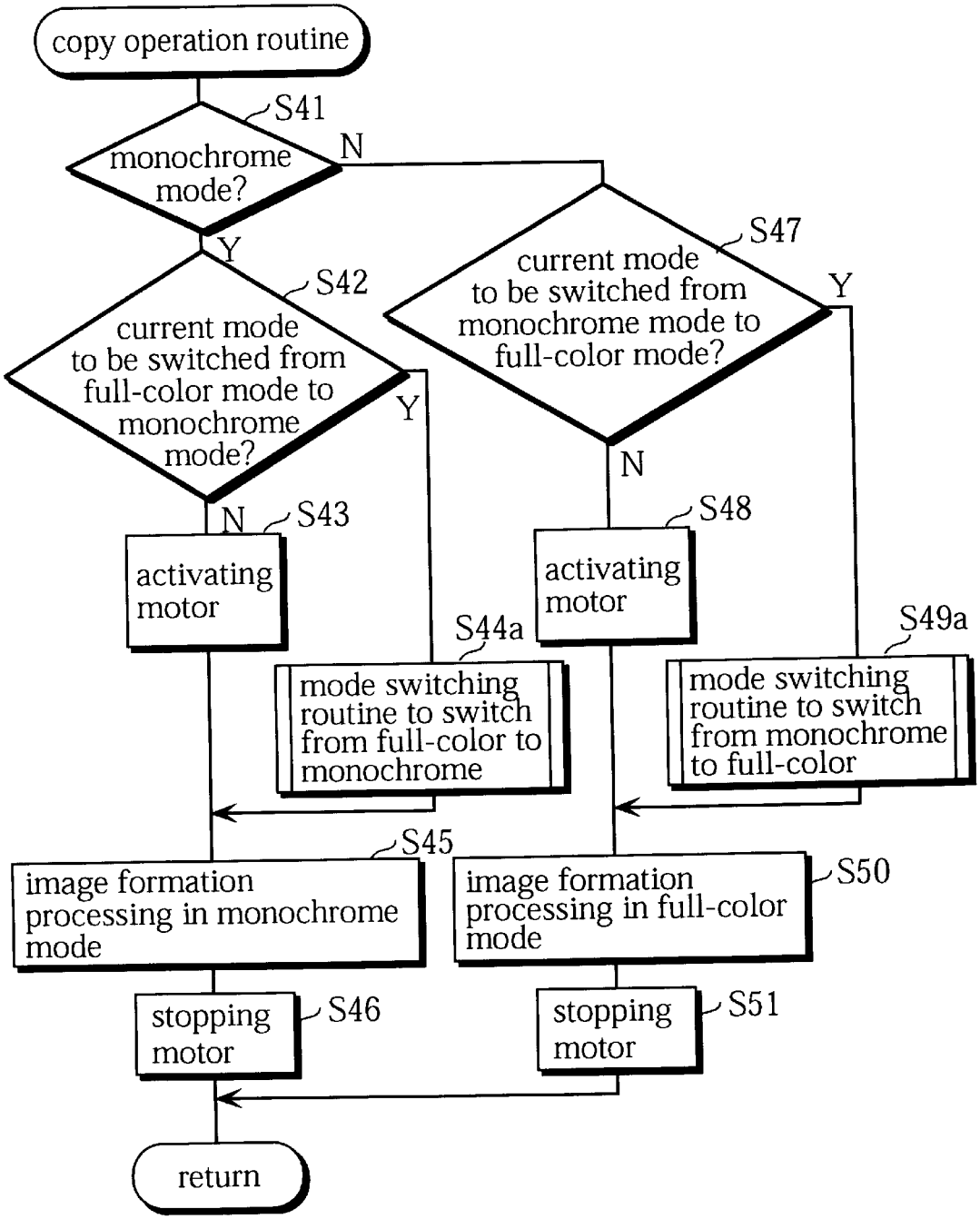
FIG. 9 is a flowchart showing a partial control operation by the drive control unit of the second embodiment.

FIG. 9 shows a copy operation routine for controlling the photosensitive drums 41C to 41K and the drive roller 32. This copy operation routine is activated by an instruction of the main control unit 71.

The CPU 62 judges from the mode setting flag whether the monochrome mode currently is set (step S41). If so, that is, if the mode setting flag is set at "0", the CPU 62 next judges whether the current mode needs to be switched from the full-color mode to the monochrome mode by referring to the mode indicating flag (step S42). If the current mode does not need to be switched, that is, if the mode indicating flag is set at "0", the CPU 62 activates the motor 54 (step S43). If the current mode needs to be switched, that is, if the mode indicating flag is set at "1", the CPU 62 executes the mode switching processing for switching the current mode from the full-color mode to the monochrome mode (step S44*a*) and then executes the image formation processing in the monochrome mode (step S45). After this, the CPU 62 controls the motor 45 to stop (step S46) and returns to the main routine (not shown).

If the monochrome mode is not set in step S41, that is, if the mode setting flag is set at "1", the CPU 62 judges from the mode indicating flag whether the current mode needs to be switched from the monochrome mode to the full-color mode (step S47). If the current mode does not need to be switched, that is, if the mode indicating flag is set at "1", the CPU 62 activates the motor 54 (step S48). If the current mode needs to be switched, that is, if the mode indicating flag is set at "0", the CPU 62 executes the mode switching processing for switching the current mode from the monochrome mode to the full-color mode (step S49*a*) and then executes the image formation processing in the full-color mode (step S50). After this, the CPU 62 controls the motor 45 to stop (step S51) and returns to the main routine (not shown).

On the completion of the image formation processing in steps S45 and S50, a signal indicating the completion of the image formation processing is inputted from the main control unit 71 to the CPU 62. As one example, the signal indicating the completion of the image formation processing is inputted when all of toner images have been transferred onto the recording sheet and the trailing edge of the recording sheet has been detected by a detecting sensor provided above the drive roller 32 so that the recording sheet does not need to be further transported by the transport belt 31.

FIG. 10 shows a subroutine of the mode switching processing for switching from the full-color mode to the monochrome mode in step 44*a* shown in FIG. 9.

The CPU 62 detects the phase angle of the photosensitive drum 41K by referring to the current count value (step S441), and stores the detected phase angle in the RAM 63 (step S442). Then, the CPU 62 disengages the clutch 53 (step S443). After this, the CPU 62 activates the motor 54 (step S444) and returns to the copy operation routine shown in FIG. 9.

FIG. 11 shows a subroutine of the mode switching processing for switching from the monochrome mode to the full-color mode in step 49*a* shown in FIG. 9.

The CPU 62 activates the motor 54 (step S491) and detects the phase angle of the photosensitive drum 41K by referring to the current count value (step S492). Then, the CPU 62 calculates a phase difference between the detected phase angle and the phase angle stored in the RAM 63 (step S493) and calculates a corresponding number of driving pulses to be inputted in the motor control circuit 65 so that the phase difference becomes zero (step S494). When the corresponding number of driving pulses are inputted, that is, when the phase of the photosensitive drum 41K relative to the phases of the photosensitive drums 41C to 41Y becomes the same as when the clutch 53 was disengaged, the CPU 62 controls the clutch 53 to be engaged (step S495) and then returns to the copy operation routine shown in FIG. 9.

As one example, suppose that image formations are successively performed two times in the monochrome mode after an image formation is performed in the full-color mode and then an image formation is performed again in the full-color mode. As shown in FIG. 12, when the full-color mode is switched to the monochrome mode, the mode switching routine is executed (see (f) in FIG. 12, step S44*a* in FIG. 9, and FIG. 10). In this mode switching processing for switching from the full-color mode to the monochrome mode, the phase angle of the photosensitive drum 41K is detected, with the motor 54 not being activated (see (d) in FIG. 12 and step S441 in FIG. 10). The detected phase angle is stored in the memory (see (e) in FIG. 12 and step S442 in FIG. 10) and the clutch 53 is disengaged (see (c) in FIG. 12 and step S443 in FIG. 10). Then, the motor 54 is activated (see (b) in FIG. 12 and step S444 in FIG. 10).

After the motor 54 is activated, only the photosensitive drum 41K is rotated for the execution of the image forming processing in the monochrome mode (as performed in step S45). As a result, the phase angle of the photosensitive drum 41K relative to the phase angles of the photosensitive drums 41C to 41Y is changed. However, none of the photosensitive drums 41C to 41K is rotated when the clutch 53 is disengaged, so that the phase angles of the photosensitive drums 41C to 41K are aligned. Therefore, the phase angle stored in the RAM 63 represents the phase angle of each photosensitive drum 41C to 41K, and this phase angle of each photosensitive drum 41C to 41Y is maintained until the photosensitive drums 41C to 41Y are next rotated.

Next, the image formation is performed again in the full-color mode after the two image formations are successively performed in the monochrome mode. When the monochrome mode is switched to the full-color mode, the mode switching routine for switching from the monochrome mode to the full-color mode is executed (see (g) in FIG. 12, step S49*a* in FIG. 9, and FIG. 11). In this mode switching processing for switching from the monochrome mode to the full-color mode, the motor 54 is activated, with the clutch 53 being disengaged (see (b) in FIG. 12 and step S491 in FIG. 11). When the phase angle of the photosensitive drum 41K which is currently being rotated (see (d) in FIG. 12 and steps S492 to S494 in FIG. 11) becomes identical to the phase angle stored in the RAM 63 (see (e) in FIG. 12 and step S442 in FIG. 10), the clutch 53 is engaged (see (c) in FIG. 12 and step S495 in FIG. 11). Then, the rotational speed of the motor 54 is increased. When each photosensitive drum 41C to 41K rotates at the system speed, the CPU 62 executes the image formation processing in the full-color mode (as performed in step S50).

Using the image formation apparatus of the present embodiment as described above, the phase angle of the photosensitive drums 41C to 41Y is stored in the memory before the clutch 53 is engaged and the phase angle of the photosensitive drum 41K can be obtained from the count value. Before the photosensitive drum 41K makes one full rotation, the phase angles of the photosensitive drums 41C to 41K can be aligned. As such, the phase alignment can be performed in a short period of time without waiting for the rotational speed of the photosensitive drums 41C to 41Y to become constant as in the case of the conventional copier. As a result, waiting time taken before the image formation is performed in the full-color mode is reduced.

Only the photosensitive drum 41K is rotated before the clutch 53 is engaged, so that a discrepancy in rotational speed emerges between the photosensitive drum 41K and the photosensitive drums 41C to 41Y when the clutch 53 is engaged. However, the motor 54 can be rotated at low speed. Even if the motor 54 is rotated in an increased speed, the phase difference becomes zero, that is, the phase angles of the photosensitive drums 41C to 41K are aligned before the photosensitive drum 41K makes one full rotation. As such, the clutch 53 is engaged when the rotational speed of the motor 54 is relatively low, so that the speed difference between the photosensitive drum 41K and the photosensitive drums 41C to 41Y is small. In addition, only the photosensitive drum 41K is rotated until the clutch 53 is engaged, so that there is no load fluctuation and no skid occurs when the clutch 53 is engaged. Accordingly, high precision is obtained for the alignment of the phases of photosensitive drums 41C to 41K and an impact force applied to the clutch 53 on its engagement can be reduced.

Since the image formation in the monochrome mode is performed with the clutch 53 being disengaged, the driving force of the motor 54 is cut off via the clutch 53 so that the photosensitive drums 41C to 41Y which are not used for forming the image in the monochrome mode are not rotated. As a result, unnecessary wear and tear on the photosensitive drums 41C to 41Y incurred by unnecessary rotations can be prevented.

The worm wheels 43C to 43K respectively mounted on the rotational shafts of the photosensitive drums 41C to 41K are set in the manner that the deformations of the worm wheels 43C to 43K are aligned in the same direction. The clutch 53 is engaged when the rotational position of the worm wheel 43K returns to the position at the previous disengagement of the clutch 53. As such, even after the clutch 53 is disengaged for the mode switching to perform the image formation in the monochrome mode, the deformations of the worm wheels 43C to 43K are aligned in the same direction when the image formation is next performed in the full-color mode. This prevents color displacements from being caused by the deformations of the worm wheels 43C to 43K.

In the present embodiment, after the phase alignment is performed (steps S492 to S494 in FIG. 11), the clutch 53 is engaged (step S495). More specifically, the clutch 53 is engaged while the photosensitive drum 41K is being rotated and the activation of the motor 54 is maintained without interruption. However, as one example, after the phase alignment is performed (steps S492 to S494), the motor 54 may be stopped once before the clutch 53 is engaged and then the motor 54 may be reactivated. By doing so, the photosensitive drum 41K is not rotated when the clutch 53 is engaged, so that the speed difference between the photosensitive drum 41K and the photosensitive drums 41C to 41Y is zero. Accordingly, an overload on the clutch 53 can be eliminated and the durability of the clutch 53 improved. In addition, the timing to engage the clutch 53 can be controlled more freely with no skid occurring when the clutch 53 is engaged. This improves the precision of the phase alignment.

Third Embodiment

The following is a description of the construction of the copier of the third embodiment. The mechanism construction of the copier and the rotational position detection routine performed by the drive control unit 60 for detecting the rotational position of the worm wheel 43K in the third embodiment are the same as those in the second embodiment. Only the copy operation routine of the third embodiment is partly different from that of the second embodiment (see FIGS. 9 to 11). Therefore, the different part of the control operation performed by the drive control unit 60 is mainly described, with reference to the flowcharts of FIGS. 13 to 15 and the timing chart of FIG. 16.

Figure 13:
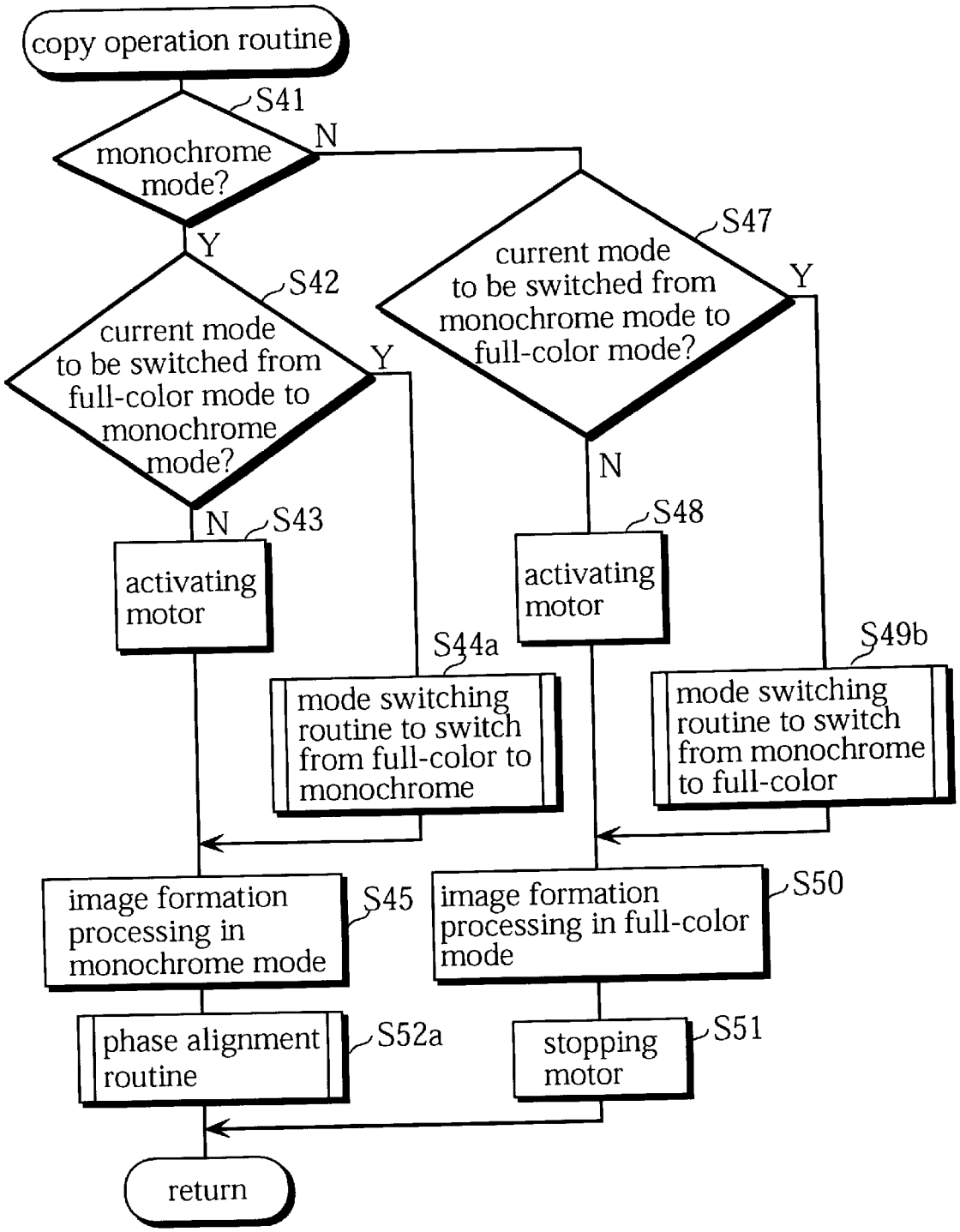
FIG. 13 is a flowchart showing a partial control operation by the drive control unit of the third embodiment.

In the copy operation routine of the second embodiment, when the image formation processing is executed in the monochrome mode (step S45 in FIG. 9), the motor 54 is stopped (step S46 in FIG. 9) and the phase alignment (steps S492 to S494 in FIG. 11) is executed in the mode switching processing for switching from the monochrome mode to the full-color mode (step S49*a* in FIG. 9). Meanwhile, as shown in FIG. 13 of the third embodiment, after the image formation processing is executed in the monochrome mode (step S45), a phase alignment routine is executed (step S52*a*). Thus, the mode switching processing for switching from the monochrome mode to the full-color mode (step S49*b*) in the third embodiment is partly different from that (step S49*a*) in the second embodiment.

Figure 14:
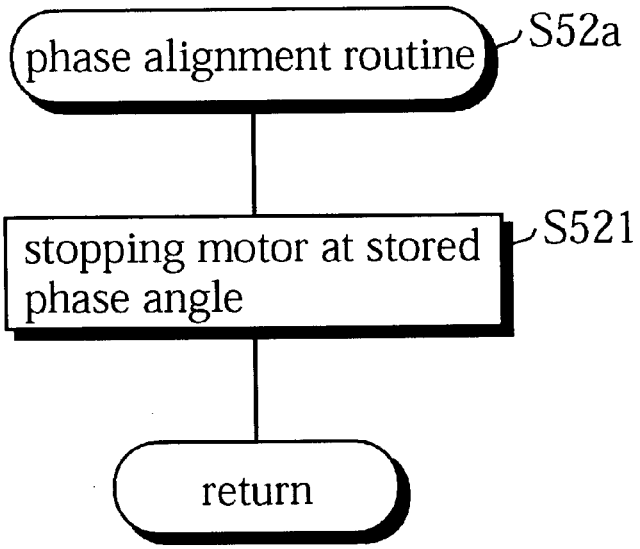
FIG. 14 shows a subroutine of the phase alignment routine shown in FIG. 13.

FIG. 14 shows a subroutine of the phase alignment routine in step S52*a* of FIG. 13.

The CPU 62 controls the motor 54 to stop when the phase angle of the photosensitive drum 41K becomes identical to the phase angle stored in the RAM 63 (step S521), and returns to the phase alignment routine in FIG. 13. As is the case with the second embodiment, the phase angle has been stored in the RAM 63 in step S442 which is included in the subroutine of step S44*a*. By means of this stored phase angle, the phase angle of the photosensitive drum 41K is made identical to the phase angles of the photosensitive drums 41C to 41Y.

Figure 15:
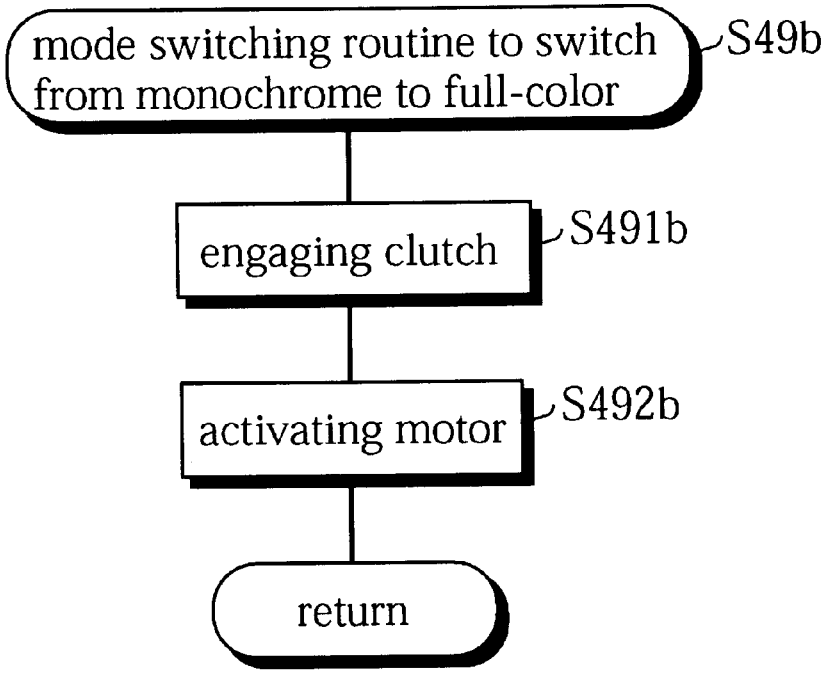
FIG. 15 shows a subroutine of the mode switching routine for switching from the monochrome mode to the full-color mode shown in FIG. 13.

FIG. 15 shows a subroutine of the mode switching processing for switching from the monochrome mode to the full-color mode in step S49*b* of FIG. 13.

The CPU 62 controls the clutch 53 to be engaged (step S491*b*) before activating the motor 54 (step S492*b*) and returns to the copy operation routine of FIG. 13.

Figure 16:
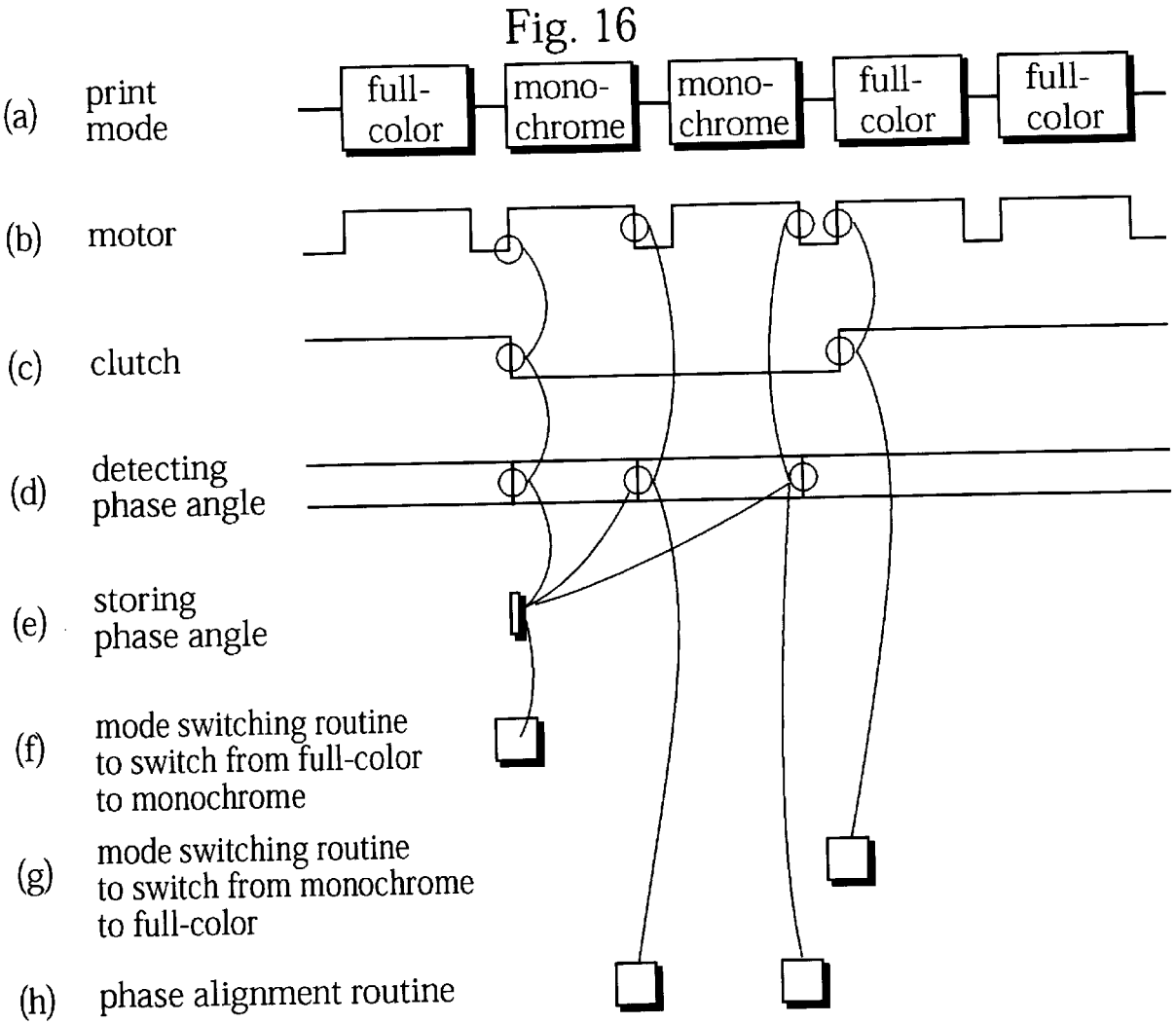
FIG. 16 is a timing chart of the control operation performed by the drive control unit.

For example, suppose that two image formations are successively performed in the monochrome mode after an image formation has been performed in the full-color mode and then an image formation is performed again in the full-color mode. As shown in FIG. 16, when the full-color mode is switched to the monochrome mode, the mode switching routine for switching from the full-color mode to the monochrome mode is executed (see (f) in FIG. 16, step S44*a* in FIG. 9, and FIG. 10). In this mode switching processing for switching from the full-color mode to the monochrome mode, the phase angle of the photosensitive drum 41K is detected, with the motor 54 not being activated (see (d) in FIG. 16 and step S441 in FIG. 10). The detected phase angle is stored in the memory (see (e) in FIG. 16 and step S442 in FIG. 10) and the clutch 53 is disengaged (see (c) in FIG. 16 and step S443 in FIG. 10). Then, the motor 54 is activated (see (b) in FIG. 16 and step S444 in FIG. 10).

After the motor 54 is activated, only the photosensitive drum 41K is rotated for the execution of the image forming processing in the monochrome mode (as performed in step S45). As a result, the phase angle of the photosensitive drum 41K relative to the phase angle of the photosensitive drums 41C to 41Y is changed. However, none of the photosensitive drums 41C to 41K is rotated when the clutch 53 is disengaged, so that the phase angles of the photosensitive drums 41C to 41K are aligned. Therefore, the phase angle stored in the RAM 63 represents the phase angle of each photosensitive drum 41C to 41K, and this phase angle of each photosensitive drum 41C to 41Y is maintained until the photosensitive drums 41C to 41Y are next rotated.

On the completion of first image formation out of the two successive image formations performed in the monochrome mode, the phase alignment routine is executed (see (h) in FIG. 16, step S52*a* in FIG. 13, and FIG. 14). The motor 54 is made to stop (see (b) in FIG. 16) with the phase angle of the photosensitive drum 41K being identical to the stored phase angle (see (d) and (e) in FIG. 16). This is to say, the phase angles of all the photosensitive drums 41C to 41K are aligned. The same processing is executed after the second image formation in the monochrome mode is performed.

Next, the image formation is performed again in the full-color mode after the two image formations are successively performed in the monochrome mode. When the monochrome mode is switched to the full-color mode, the mode switching routine for switching the monochrome mode to the full-color mode is executed (see (g) in FIG. 16, step S49*b* in FIG. 13, and FIG. 15). Before performing this mode switching processing for switching from the monochrome mode to the full-color mode, the phase alignment of the photosensitive drums 41C to 41K has already been performed. As such, the clutch 53 is engaged (see (c) in FIG. 16 and step S491 in FIG. 15) before the motor 54 is activated (see (b) in FIG. 16 and step S492 in FIG. 15). When each photosensitive drum 41C to 41K rotates at the system speed, the CPU 62 executes the image formation processing in the full-color mode (as performed in step S50).

Accordingly, the phase alignment of the photosensitive drums 41C to 41K is performed on the completion of the image formation in the monochrome mode in the third embodiment. Therefore, when the image formation is next performed in the full-color mode, the processing is started simply by engaging the clutch 53. In other words, the image formation in the full-color mode can be readily performed even after the image formation has been performed in the monochrome mode. On starting the image formation processing in the full-color mode, the speed difference between the photosensitive drum 41K and the photosensitive drums 41C to 41Y is zero since the photosensitive drum 41K is not being rotated when the clutch 53 is engaged. Accordingly, an overload on the clutch 53 can be eliminated and durability of the clutch 53 is improved. In addition, no skid occurs when the clutch 53 is engaged, which improves the precision of the phase alignment.

Fourth Embodiment

The following is a description of the construction of the copier of the fourth embodiment. The mechanism construction of the copier and the routines executed by the drive control unit 60 in the fourth embodiment are basically the same as those in the second and third embodiments. Therefore, a different part of the control operation performed by the drive control unit 60 of the fourth embodiment is mainly described, with reference to the flowcharts of FIGS. 17 to 19 and the timing chart of FIG. 20.

In the present embodiment, the clutch 53 is engaged/disengaged only when the standard slit 45*a* is detected by the photo interrupter 46. Therefore, the encoder pulses do not need to be counted and the phase angle does not need to be stored.

Although the motor 54 is made to stop after the image formation is performed in the full-color mode (step S50) in the third embodiment, step S50 is skipped and the phase alignment routine (step S52*b*) is also executed after the image formation is performed in the full-color mode in the present embodiment.

In the mode switching processing for switching the mode from the full-color mode to the monochrome mode in the second and third embodiments (see step S44*a* in FIG. 9 and FIG. 10), the phase angle of the photosensitive drum 41K is detected (step S441) and stored in the RAM 63 (step S442), and then the clutch 53 is disengaged (step S443) before the motor 54 is activated (step S444). On the other hand, in the fourth embodiment, after the clutch 53 is disengaged (step S443) and the motor 54 is activated (step S444), the CPU 62 returns to the copy operation routine of FIG. 17 as shown in FIG. 18.

Figure 19:
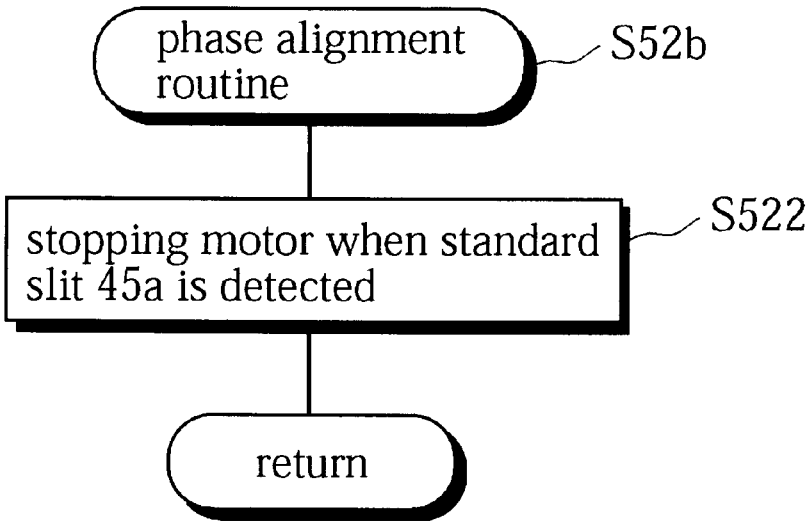
FIG. 19 shows a subroutine of the phase alignment routine shown in FIG. 17.

In the phase alignment routine in the third embodiment, the motor 54 is stopped when the phase angle of the photosensitive drum 41K is identical to the phase angle which is stored in the RAM 63 when the mode switching processing for switching from the full-color mode to the monochrome mode is performed (step S521). However, in the phase alignment routine of the fourth embodiment (step S52*b*) as shown in FIG. 19, the motor 54 is stopped when the standard slit 45*a* is detected (step S522).

Figure 20:
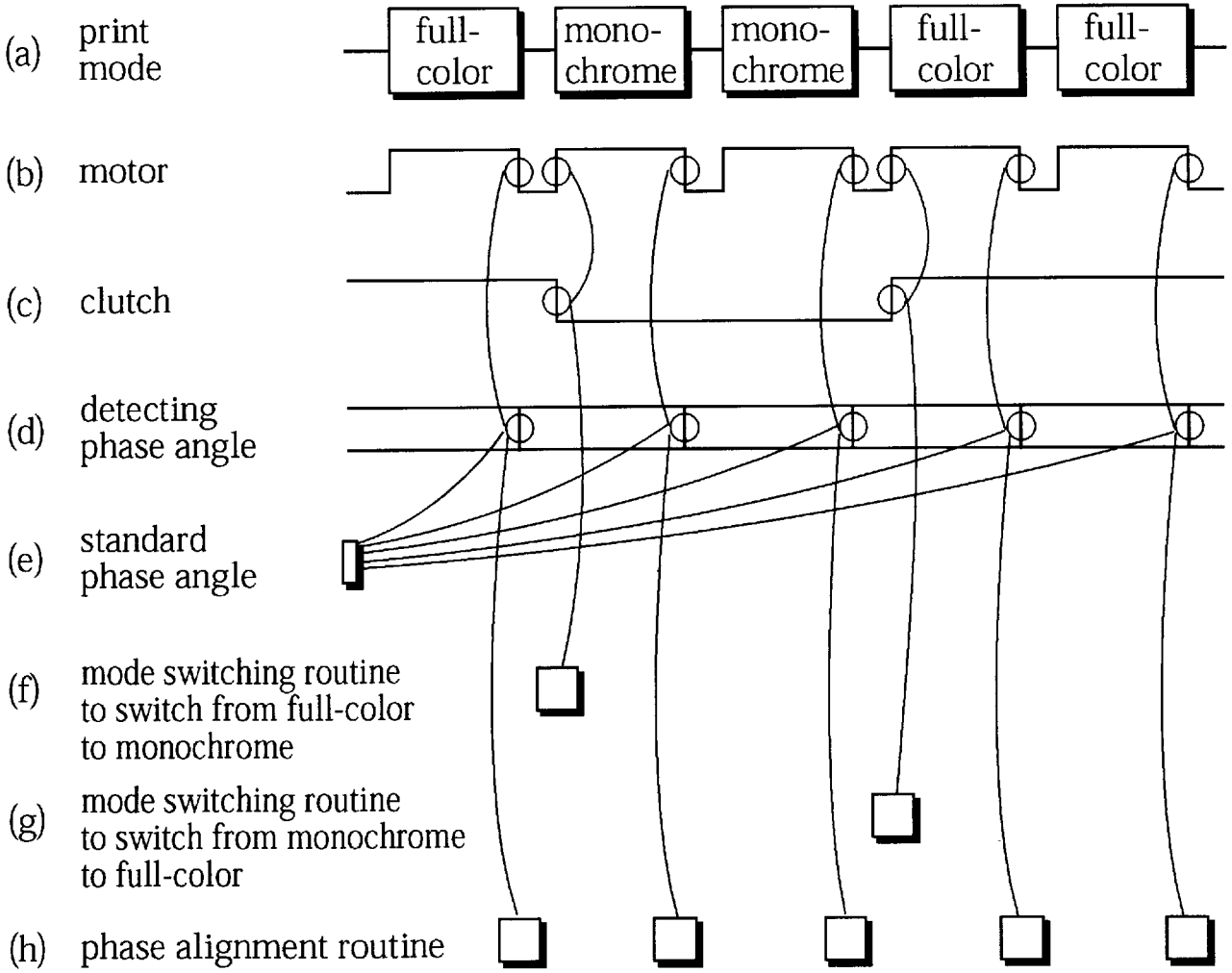
FIG. 20 is a timing chart of the control operation performed by the drive control unit of the fourth embodiment.

For example, suppose that two image formations are successively performed in the monochrome mode after an image formation has been performed in the full-color mode and then an image formation is performed again in the full-color mode. As shown in FIG. 20, the phase alignment routine is executed on the completion of the image formation performed in the full-color mode (see (h) in FIG. 20, step S52*b* in FIG. 13, and FIG. 14). Then, the motor 54 is stopped (see (b) in FIG. 20) when the standard slit 45*a* is detected (see (d) in FIG. 20). In other words, the phase angles of the photosensitive drums 41C to 41K are aligned.

Figure 17:
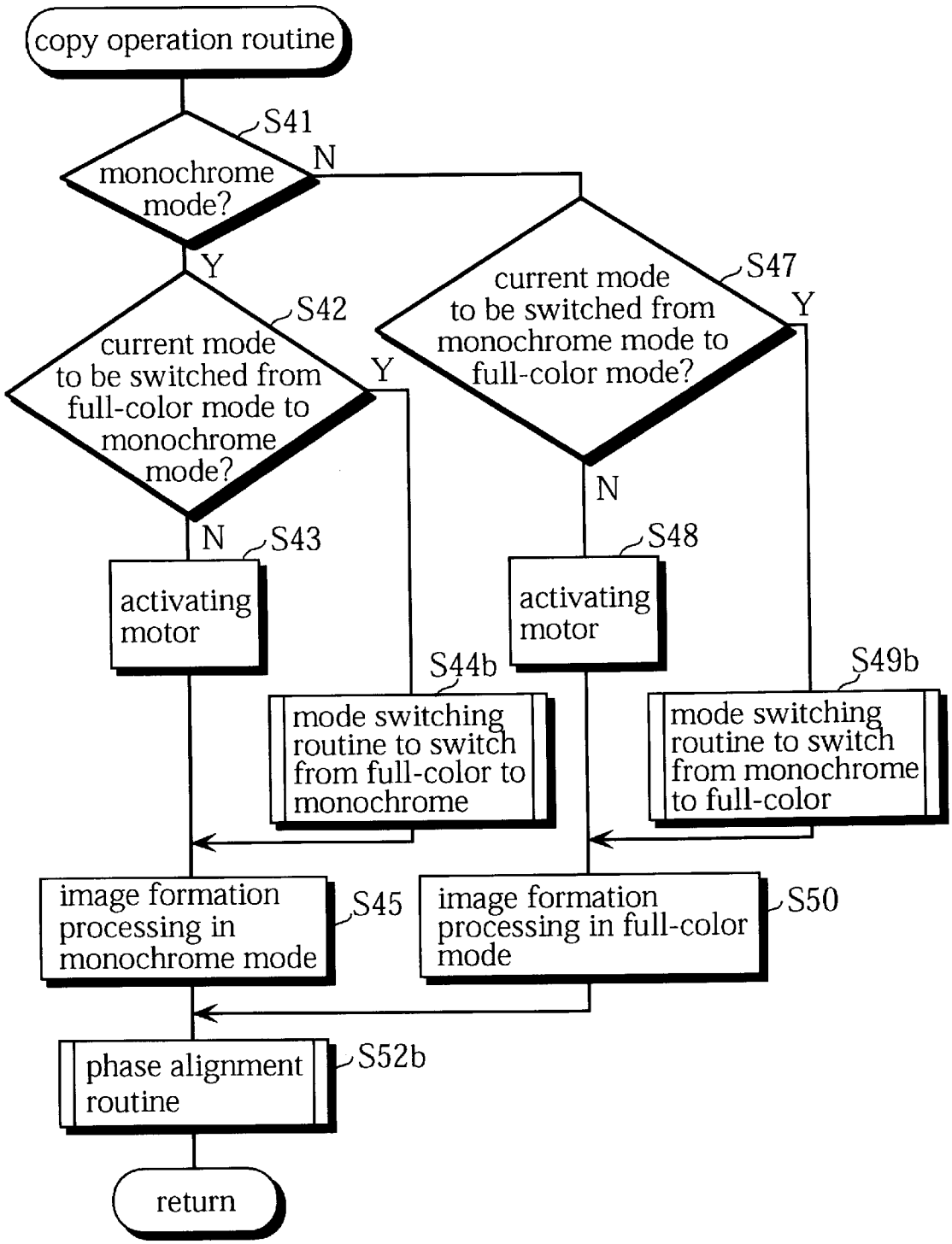
FIG. 17 is a flowchart showing a partial control operation performed by the drive control unit of the fourth embodiment.
Figure 18:
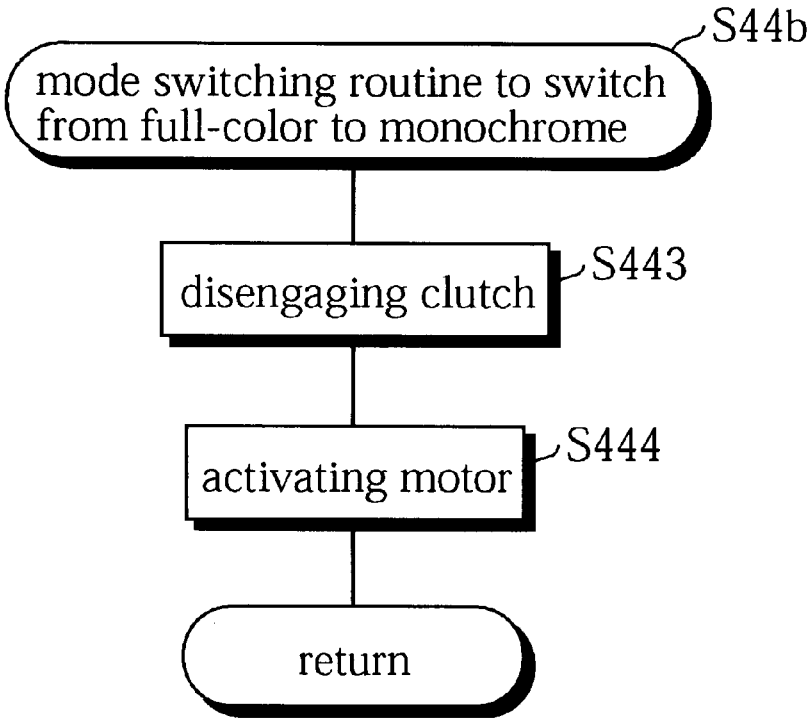
FIG. 18 shows a subroutine of the mode switching routine for switching from the monochrome mode to the full-color mode shown in FIG. 17.

When the full-color mode is switched to the monochrome mode, the mode switching routine for switching the full-color mode to the monochrome mode is executed (see (f) in FIG. 20, step S44*b* in FIG. 17, and FIG. 18). In this mode switching processing for switching from the full-color mode to the monochrome mode, the clutch 53 is disengaged (see (c) in FIG. 20 and step S443 in FIG. 18) and then the motor 54 is activated (see (b) in FIG. 20 and step S444 in FIG. 18).

After the motor 54 is activated, only the photosensitive drum 41K is rotated for the execution of the image forming processing in the monochrome mode (as performed in step S45). As a result, the phase angle of the photosensitive drum 41K relative to the phase angle of the photosensitive drums 41C to 41Y is changed. However, all of the photosensitive drums 41C to 41K are not rotated when the clutch 53 is disengaged, so that the phase angles of the photosensitive drums 41C to 41K are aligned.

On the completion of the first image formation out of the two successive image formations performed in the monochrome mode, the phase alignment routine is executed (see (h) in FIG. 20, step S52*a* in FIG. 13, and FIG. 14). The motor 54 is made to stop (see (b) in FIG. 20) when the standard slit 45*a* is detected (see (d) in FIG. 20). This is to say, the phase angle of the photosensitive drums 41K is aligned with the phase angle of the photosensitive drums 41C to 41Y. The same processing is executed after the second image formation in the monochrome mode is performed.

Next, the image formation is performed again in the full-color mode after the two image formations are successively performed in the monochrome mode. When the monochrome mode is switched to the full-color mode, the mode switching routine for switching from the monochrome mode to the full-color mode is executed (see (g) in FIG. 20, step S49*b* in FIG. 17, and FIG. 15). Before performing this mode switching processing for switching from the monochrome mode to the full-color mode, the phase alignment of the photosensitive drums 41C to 41K has already been performed. As such, the clutch 53 is engaged (see (c) in FIG. 20 and step S491 in FIG. 15) before the motor 54 is activated (see (b) in FIG. 20 and step S492 in FIG. 15). When the rotational speed of each photosensitive drum 41C to 41K becomes constant at the system speed, the CPU 62 executes the image formation processing in the full-color mode (as performed in step S50).

Accordingly, on the completion of the image formation performed in the full-color mode, phase alignment is performed, making the phase angles of the photosensitive drums 41C to 41K aligned. Meanwhile, on the completion of the image formation performed in the monochrome mode, the photosensitive drum 41K is made to stop on the detection of the standard slit 45*a* so that the phase angles of the photosensitive drums 41C to 41K are aligned. As a result, when the image formation is next performed in the full-color mode, the processing is started simply by engaging the clutch 53. In other words, the image formation in the full-color mode can be readily performed even after the image formation has been performed in the monochrome mode. On starting the image formation processing in the full-color mode, the speed difference between the photosensitive drum 41K and the photosensitive drums 41C to 41Y is zero since the photosensitive drum 41K is not being rotated when the clutch 53 is engaged. Accordingly, an overload on the clutch 53 can be eliminated and durability of the clutch 53 is improved. In addition, no skid occurs when the clutch 53 is engaged, which improves the precision of the phase alignment.

Although the standard slit 45*a* of the slit circular plate 45 is detected in the present embodiment, the marking 44K may be detected. As one example in this case, a reflecting sticker may be affixed to the marking 44K and a reflectance-type photo sensor may detect the reflecting sticker of the marking 44K.

Modifications

The image forming apparatus of the present invention has been described according to the above embodiments, although it should be obvious that the present invention is not limited to these embodiments. For example, the following modifications can be made.

The rotary encoder 44 used in the stated embodiments obtains the phase angle of the photosensitive drum 41K by counting the number of slits passing by the photo interrupter. However, a rotary encoder of different type may be used. In this case, different arrangements of slits may be formed on the slit circular plate 45 in the radial direction, depending on the position. As a result, the rotary encoder can obtain the phase angle of the photosensitive drum 41K by detecting the arrangement of the slits. In addition, a rotary encoder of this type may be provided for not only for the photosensitive drum 41K but also for the photosensitive drums 41C to 41Y. By doing so, the required phase angle does not need to be stored in the memory and the phase angles of the photosensitive drums 41C to 41K can be detected whenever necessary. Also, phase alignment can be reliably performed even when the photosensitive drums 41C to 41Y are rotated due to the vibration caused by the disengagement of the clutch 53.

In the stated embodiments, the monochrome mode is described as a reduced-color mode. However, the image formation in the reduced-color mode may be performed using one of colors C, M, and Y. Alternatively, two or three colors out of C, M, Y, and K may be used in the reduced-color mode. In this case, the location of the clutch 53 and the arrangement of the photosensitive drums 41C to 41K may be changed accordingly.

The worm wheels 43C to 43K are respectively mounted on the rotational shafts of the photosensitive drums 41C to 41K so that the driving force of the motor 54 is transmitted via the worm gears in the stated embodiments. However, pulleys may be respectively mounted on the rotational shafts of the photosensitive drums 41C to 41K so that the driving force of the motor 54 may be transmitted via belts, as in the conventional copier.

Although the phase angle of the photosensitive drum 41K affected by the eccentricity of the worm wheel 43K is detected by the rotary encoder 44 in the stated embodiments, the phase angle of the photosensitive drum 41K affected by the eccentricity of the pulley which finally transmits the driving force may be detected. When only the photosensitive drum 41K is eccentric, the phase angle of the photosensitive drum 41K may be detected. Alternatively, when the photosensitive drum 41K, the worm wheel 43K, and the pulley are eccentric, the phase angle of the photosensitive drum 41K affected by the eccentricities of the worm wheel 43K and the pulley may be detected.

Although the photosensitive drums are used in the stated embodiments, a photosensitive belt may be used instead.

The copier is described as the present invention in the stated embodiments, the present invention is not limited to this. For example, the present invention may be used for an image forming apparatus, such as a laser printer.

Although the present invention has been fully described by way of examples with reference to the accompanying drawings, it is to be noted that various changes and modifications will be apparent to those skilled in the art.

Therefore, unless such changes and modifications depart from the scope of the present invention, they should be constructed as being included therein.

What is claimed is:

1. An image forming apparatus comprising:

an image forming device which selectively operates in one of a full-color mode and a reduced-color mode, the full-color mode being where an image is formed using all of a plurality of photosensitive components that are set in line, and the reduced-color mode being where an image is formed using at least one but not all of the photosensitive components;

a driving source for rotating the plurality of photosensitive components;

a first driving force transmission unit for transmitting a driving force of the driving source to a first group including at least one photosensitive component;

a driving force interruption unit for interrupting the driving force of the driving source for a second group including a plurality of photosensitive components aside from the photosensitive components included in the first group by being engaged and disengaged;

a second driving force transmission unit for transmitting the driving force of the driving source to the second group via the driving force interruption unit when the driving force interruption unit is engaged; and a control unit for controlling an engaged state and a disengaged state of the driving force interruption unit in accordance with a current mode and for switching from the disengaged state to the engaged state when a phase of the photosensitive components in the first group is equal to a phase of the photosensitive components in the second group before the driving force interruption unit was switched to the disengaged state.

2. The image forming apparatus of claim 1, wherein the control unit includes:

a phase obtaining unit for obtaining a rotational phase of the photosensitive components in the second group when a state of the driving force interruption unit is switched from the engaged state to the disengaged state;

a phase detection unit for detecting a rotational phase of the photosensitive components in the first group;

a judgment unit for judging whether the rotational phase detected by the phase detection unit is equal to the rotational phase obtained by the phase obtaining unit; and a switching unit for switching from the disengaged state to the engaged state of the driving force interruption unit when the judgment unit judges that the rotational phase detected by the phase detection unit is equal to the rotational phase obtained by the phase obtaining unit.

3. The image forming apparatus of claim 2, wherein the switching unit switches a state of the driving force interruption unit from the disengaged state to the engaged state, while the photosensitive components in the first group are being rotated.

4. The image forming apparatus of claim 2, wherein the control unit further includes a driving source control unit for stopping the driving source before a switching operation is performed by the switching unit when the judgement unit judges that the rotational phase detected by the phase detection unit is equal to the rotational phase obtained by the phase obtaining unit.

5. The image forming apparatus of claim 1, wherein the control unit includes:

a disengagement control unit for controlling a switching operation to set a state of the driving force interruption unit to the disengaged state when a rotational phase of the photosensitive components in the second group is equal to a standard phase; and an engagement control unit for controlling a switching operation to set the state of the driving force interruption unit to the engaged state when the rotational phase of the photosensitive components in the first group is equal to the standard phase.

6. The image forming apparatus of claim 1, wherein the control unit includes:

a phase detection unit for detecting a rotational phase of the photosensitive components in the first group;

a driving source control unit for stopping the driving source when the phase detection unit detects a standard phase after an image formation is performed in one of the full-color mode and the reduced-color mode; and a switching unit for switching a state of the driving force interruption unit before the driving source is activated for an image formation.

7. The image forming apparatus of claim 1, wherein the control unit includes:

a phase obtaining unit for obtaining a rotational phase of the photosensitive components in the second group when the driving force interruption unit is switched from the engaged state to the disengaged state;

a phase detection unit for detecting a rotational phase of the photosensitive components in the first group;

a driving source control unit for stopping the driving source when the phase detection unit detects a same phase as a phase obtained by the phase obtaining unit after an image formation is performed in the reduced-color mode; and a switching unit for switching a state of the driving force interruption unit before the driving source is activated for an image formation, when switching from the reduced-color mode to the full-color mode.

8. An image forming apparatus comprising:

a plurality of image holding components set along a transportation path of a recording sheet, each image holding component being operable at a monochrome mode and a full-color mode and an image holding component used for forming a black image being located nearest to a driving source;

a worm shaft which is set parallel to the transportation path of the recording sheet with one end is connected to the driving source;

a worm wheel which is attached to each image holding component and engages with the worm shaft; and a clutch which is set on the worm shaft and located between the image holding component used for forming a black image and an image holding component located next to the image holding component used for forming a black image, an engagement and a disengagement of the clutch being performed in synchronization with a switching operation to switch between the monochrome mode and the full-color mode.

9. The image forming apparatus of claim 8 further comprising:

a rotational position detection unit for detecting a rotational position of the worm wheel set on the image holding component used for forming a black image;

a storage unit for storing the rotational position detected by the rotational position detection unit when the clutch is disengaged; and a clutch control unit for engaging the clutch when the rotational position detected by the rotational position detection unit is equal to the rotational position stored in the storage unit.

10. The image forming apparatus of claim 8 further comprising a transportation unit for revolving a transport belt using a drive roller and for transporting a recording sheet held on the transport belt along the transportation path, wherein a distance between neighboring image holding components is set equivalent to an integral multiple of a distance moved by the transport belt as a result of one rotation made by the drive roller.

11. The image forming apparatus of claim 9 further comprising a transportation unit for revolving a transport belt using a drive roller and for transporting a recording sheet held on the transport belt along the transportation path, wherein a distance between neighboring image holding components is set equivalent to an integral multiple of a distance moved by the transport belt as a result of one rotation made by the drive roller.

12. An image forming apparatus, comprising:

a first group including at least one image holding component;

a second group including a plurality of image holding components aside from the image holding components included in the first group;

a driving device for driving the image holding components in the first group and the second group;

a driving force transmission device for transmitting a driving force of the driving device to each image holding component;

a transmission switching device for switching a state of the driving force transmission device between a transmission state where the driving force is transmitted to the second group by the driving force transmission device and a non-transmission state where the driving force is not transmitted to the second group by the driving force transmission device; and a control device for controlling the transmission switching device to switch a state of the driving force transmission device from the non-transmission state to the transmission state when a phase of the image holding components in the first group is equal to a phase of the image holding components in the second group.

13. The image forming apparatus of claim 12 further comprising a rotational phase obtaining device for obtaining a phase of the the image holding components in the second group, wherein the control device controls the transmission switching device to switch the state of the driving force transmission device from the non-transmission state to the transmission state for the second group, when the phase of the image holding components in the first group detected while each image holding component in the first group is being rotated is equal to a predetermined phase.

14. The image forming apparatus of claim 12, wherein the first group is set nearer to the driving device than the second group, wherein the driving force transmission device includes:

a worm shaft having a plurality of worms thereon, with one end of the worm shaft being connected to the driving device; and a worm wheel set on each image holding component and engaging with a corresponding worm set on the worm shaft, and wherein the transmission switching device includes a clutch which is set on the worm shaft and located between the first group and the second group.

15. The image forming apparatus of claim 14, further comprising:

a rotational position detection device for detecting a rotational position of the worm wheel set on each image holding component in the first group; and a storage device for storing the rotational position detected by the rotational position detection device when the clutch is disengaged, wherein the control device controls to switch the state of the driving force transmission device from the non-transmission state to the transmission state for the second group, when the rotational position detected by the rotational position detection device is equal to the rotational position stored in the storage device.

16. The image forming apparatus of claim 12 further comprising a transportation unit for revolving an endless belt using a drive roller and for sequentially transporting a recording sheet held on the endless belt to the image holding components, wherein a distance between neighboring image holding components is set equivalent to an integral multiple of a distance that the endless belt moves as a result of one rotation made by the drive roller.

17. A mode switching method for switching from a full-color mode to a reduced-color mode and for switching from the reduced-color mode to the full-color mode in an image forming apparatus which comprises a first group including at least one image holding component, a second group including a plurality of image holding components aside from the image holding components included in the first group, a driving source for driving each image holding component, and a clutch for interrupting a driving force of the driving source transmitted to the second group, and which selectively operates in one of the full-color mode and the reduced-color mode, the full-color mode being where an image is formed using the first group and the second group, and the reduced-color mode being where an image is formed using only the first group, the mode switching method for switching from the full-color mode to the reduced-color mode including:

a first step for detecting a rotational phase of one of image holding components;

a second step for disengaging the clutch; and a third step for storing the rotational phase detected in the first step when the clutch is disengaged in the second step, and the mode switching method for switching from the reduced-color mode to the full-color mode including:

a first step for detecting a rotational phase of the image holding components in the first group;

a second step for judging whether the rotational phase of the image holding components in the first group detected in the first step is equal to the stored rotational phase; and a third step for engaging the clutch when the rotational phase of the image holding components in the first group detected in the first step is judged to be equal to the stored rotational phase.

18. An image forming apparatus for selectively use in a monochrome mode and a full-color mode, the image forming apparatus comprising:

a first image holder holding a black image;

a second image holder;

a drive member engaging the first image holder and the second image holder; and a clutch provided in the drive member at a position between the first image holder and the second image holder, the clutch being activated according to a selection of the monochrome mode or the full-color mode.

19. The image forming apparatus of claim 18, further comprising a drive source which is located at an opposite position of the clutch with respect to the first image holder, and applies a drive-power to the drive member.

* * * * *